US011844972B2

(12) United States Patent
Miller et al.

(10) Patent No.: US 11,844,972 B2
(45) Date of Patent: Dec. 19, 2023

(54) DRY SPRINKLER ASSEMBLIES

(71) Applicant: Tyco Fire Products LP, Lansdale, PA (US)

(72) Inventors: Lyle Miller, Milford, CT (US); Yoram Ringer, Providence, RI (US)

(73) Assignee: Tyco Fire Products LP, Cranston, RI (US)

( * ) Notice: Subject to any disclaimer, the term of this patent is extended or adjusted under 35 U.S.C. 154(b) by 4 days.

(21) Appl. No.: 17/379,299

(22) Filed: Jul. 19, 2021

(65) Prior Publication Data

US 2021/0346743 A1 Nov. 11, 2021

Related U.S. Application Data

(63) Continuation of application No. 16/159,156, filed on Oct. 12, 2018, now Pat. No. 11,065,487, which is a (Continued)

(51) Int. Cl.

| | |
|---|---|
| ***A62C 35/62*** | (2006.01) |
| ***B05B 1/26*** | (2006.01) |
| *A62C 3/00* | (2006.01) |

(52) U.S. Cl.

CPC ..... *A62C 35/62* (2013.01); *B05B 1/265* (2013.01); *A62C 3/004* (2013.01)

(58) Field of Classification Search

CPC ..... A62C 3/004; A62C 35/68; A62C 35/62; A62C 37/11; A62C 31/02; A62C 37/14; B05B 1/265; B05B 1/267

(Continued)

(56) References Cited

U.S. PATENT DOCUMENTS 5,152,344 A 10/1992 Fischer et al.
5,687,914 A * 11/1997 Bosio ..... B05B 1/265 169/37

(Continued)

FOREIGN PATENT DOCUMENTS

WO WO-02/30516 A1 4/2002
WO WO-2006/133057 A2 12/2006

(Continued)

OTHER PUBLICATIONS

European Patent Application No. 13721182.

(Continued)

*Primary Examiner* — Christopher R Dandridge
(74) *Attorney, Agent, or Firm* — Foley & Lardner LLP

(57) ABSTRACT

A dry sprinkler assembly capable of providing fire suppression protection, including early suppression fast response protection and storage protection of a commodity having a nominal storage height of at least 20 feet beneath a ceiling of with a maximum nominal 40 foot ceiling height. The dry sprinkler assembly includes an internal passageway and an outlet defining a nominal K-factor of at least 16.8 GPM/PSI1'2. Embodiments of the sprinkler assembly include a deflector having a plurality of tines radially disposed about a central portion to define slots therebetween. Embodiments of the deflector define a non-planar deflecting member and a member with a non-circular perimeter. Installation of the sprinkler assembly provides for a insulation sealing assembly having a insulation ring, planar insert member and a surrounding housing.

20 Claims, 10 Drawing Sheets

Related U.S. Application Data continuation of application No. 14/395,036, filed as application No. PCT/US2013/037482 on Apr. 19, 2013, now Pat. No. 10,099,080.

(60) Provisional application No. 61/789,182, filed on Mar. 15, 2013, provisional application No. 61/636,633, filed on Apr. 21, 2012, provisional application No. 61/636,556, filed on Apr. 20, 2012.

(58) Field of Classification Search
USPC ..... 169/37
See application file for complete search history.

(56) References Cited

U.S. PATENT DOCUMENTS

| | | | | |
|---|---|---|---|---|
| 5,775,431 | A | 7/1998 | Ondracek | |
| 5,865,256 | A | 2/1999 | Pounder | |
| 6,854,668 | B2 * | 2/2005 | Wancho | A62C 37/14 239/524 |
| 7,165,624 | B1 * | 1/2007 | Fischer | A62C 31/02 169/37 |
| 7,516,800 | B1 | 4/2009 | Silva et al. | |
| 7,559,376 | B2 | 7/2009 | Silva, Jr. | |
| 7,793,736 | B2 | 9/2010 | Golinveaux et al. | |
| 11,065,487 | B2 * | 7/2021 | Miller | A62C 35/62 |
| 2006/0102362 | A1 * | 5/2006 | S. Polan | A62C 37/09 169/37 |
| 2007/0187116 | A1 * | 8/2007 | Jackson | A62C 3/004 169/17 |
| 2008/0011491 | A1 * | 1/2008 | Thau | A62C 31/02 239/597 |
| 2009/0294138 | A1 | 12/2009 | Jackson et al. | |
| 2011/0036598 | A1 * | 2/2011 | Pahila | A62C 3/002 169/37 |
| 2011/0315406 | A1 | 12/2011 | Connery et al. | |

FOREIGN PATENT DOCUMENTS

| | | | |
|---|---|---|---|
| WO | WO-2007/024554 | A2 | 3/2007 |
| WO | WO-2008/054863 | A2 | 5/2008 |
| WO | WO-2009/014136 | | 1/2009 |
| WO | WO-2009/141316 | A1 | 11/2009 |
| WO | WO-2010/141948 | A1 | 12/2010 |
| WO | WO-2013/003626 | A2 | 1/2013 |

OTHER PUBLICATIONS

FM Global Group, FM Approvals, Approval Standard for Suppression Mode [Early Suppression Fast Response ESFR] Automatic Sprinklers, Class No. 2008, Oct. 2006, 89 pages.

International Search Report and Written Opinion on PCT/US2013/037482, dated Oct. 8, 2014, 19 pages.

National Fire Protection Association, NFPA 13 Standard for the Installation of Sprinkler Systems 2010 Edition, 19 pages.

National Fire Protection Association, NFPA 13 Standard for the Installation of Sprinkler Systems 2013 Edition.

Notification of Transmittal of International Search Report and Written Opinion of the International Searching Authority, dated Oct. 8, 2014, 20 pages.

The Viking Corporation, Dry Sprinkler Insulating Boot Assembly Part No. 13864 data sheet, Form No. F030107, Sprinkler 132c, May 6, 2011, 4 pages.

The Viking Corporation, ESFR Dry Pendent Sprinkler VK501 (K14.0) data sheet, Form No. F050707, Sprinkler 122a, Sep. 13, 2012, 8 pages.

U.S. Appl. No. 61/636,556, filed Apr. 20, 2012.

U.S. Appl. No. 61/636,633, filed Apr. 21, 2012.

U.S. Appl. No. 61/789,182, filed Mar. 15, 2013.

Underwriters Laboratories Inc., Early-Suppression Fast-Response Sprinklers, UL 1767, Sep. 2, 2010, pp. 22-40.

* cited by examiner

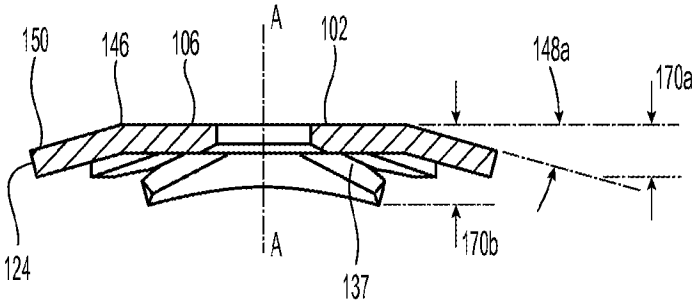
Fig. 6B
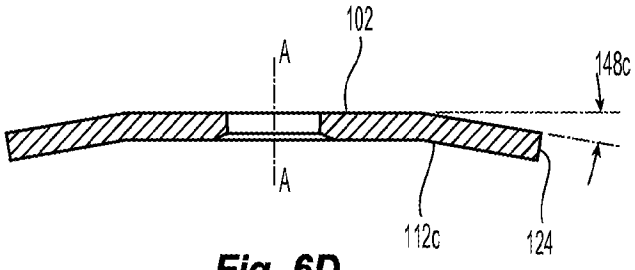
Fig. 6D
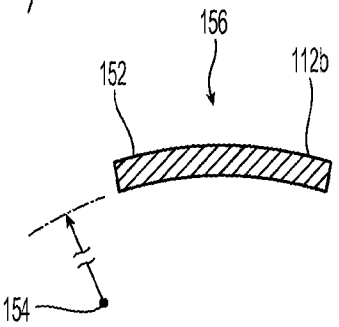
Fig. 6F
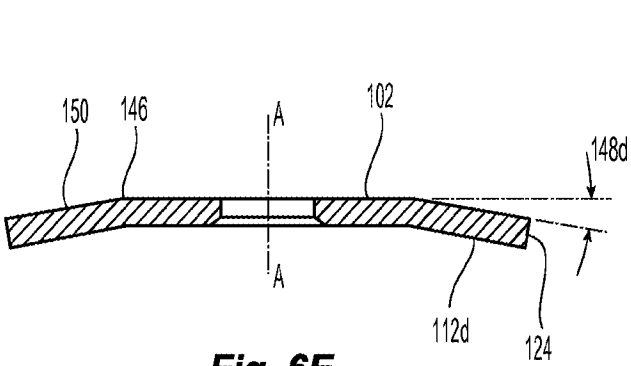
Fig. 6C
Fig. 6E

DRY SPRINKLER ASSEMBLIES

PRIORITY DATA AND INCORPORATION BY REFERENCE

This application is a continuation of U.S. patent application Ser. No. 16/159,156, filed Oct. 12, 2018, which is a continuation of U.S. patent application Ser. No. 14/395,036 filed Oct. 16, 2014, which is a National Stage Application of International Patent Application No. PCT/US2013/037482 filed Apr. 19, 2013, which claims the benefit of U.S. Provisional Application No. 61/789,182 filed Mar. 15, 2013, U.S. Provisional Application No. 61/636,633 filed Apr. 21, 2012 and U.S. Provisional Application No. 61/636,556 filed Apr. 20, 2012, each of which is incorporated by reference in its entirety.

BACKGROUND OF THE INVENTION

Automatic sprinkler systems are some of the most widely used devices for fire protection. These systems have sprinklers that are activated once the ambient temperature in an environment, such as a room or building exceeds a predetermined value. Once activated, the sprinklers distribute fire-extinguishing fluid, preferably water, in the room or building. A sprinkler system is considered effective if it extinguishes or prevents growth of a fire. The effectiveness of a sprinkler is dependent upon the sprinkler consistently delivering an expected flow rate of fluid from its outlet for a given pressure at its inlet. The discharge coefficient or K-factor of a sprinkler allows for an approximation of flow rate to be expected from an outlet of a sprinkler based on the square root of the pressure of fluid fed into the inlet of the sprinkler. As used herein, the K-factor is defined as a constant representing the sprinkler discharge coefficient, that is quantified by the flow of fluid in gallons per minute (GPM) from the sprinkler outlet divided by the square root of the pressure of the flow of fluid fed into the inlet of the sprinkler passageway in pounds per square inch (PSI). The K-factor is expressed as $GPM/(PSI)^{1/2}$. Industry accepted standards, such as for example, the National Fire Protection Association (NFPA) standard entitled, "NFPA 13: Standards for the Installation of Sprinkler Systems" (2010 ed.) ("NFPA 13") and its updated edition NFPA 13 (2013 ed.), which provide for a rated or nominal K-factor or rated discharge coefficient of a sprinkler as a mean value over a K-factor range. For example for a K-factor greater than 14, NFPA 13 provides the following nominal K-factors (with the K-factor range shown in parenthesis): (i) 16.8 (16.0-17.6) $GPM/(PSI)^{1/2}$; (ii) 19.6 (18.6-20.6) $GPM/(PSI)^{1/2}$; (iii) 22.4 (21.3-23.5) $GPM/(PSI)^{1/2}$; (iv) 25.2 (23.9-26.5) $GPM/(PSI)^{1/2}$; (v) 28.0 (26.6-29.4) $GPM/(PSI)^{1/2}$ or higher.

The fluid supply for a sprinkler system may include, for example, an underground water main that enters the building to supply a vertical riser. At the top of a vertical riser, an array of pipes extends throughout the fire compartment in the building. In the piping distribution network atop the riser includes branch lines that carry the pressurized supply fluid to the sprinklers. A sprinkler may extend up from a branch line, placing the sprinkler relatively close to the ceiling, or a sprinkler can be pendent below the branch line. For use with concealed piping, a flush-mounted pendent sprinkler may extend only slightly below the ceiling.

Fluid for fighting a fire can be provided to the sprinklers in various configurations. In a wet-pipe system, for buildings having heated spaces for piping branch lines, all the system pipes contain water for immediate release through any sprinkler that is activated. In a dry-pipe system, branch lines and other distribution pipes may contain a dry gas (air or nitrogen) under pressure. Dry pipe systems may be used to protect unheated open areas, cold rooms, buildings in freezing climates, cold-storage room passageways, storage or other occupancies exposed to freezing temperatures. The gas pressure in the distribution pipes may be used to hold closed a dry pipe valve at the riser to control the flow of fire fighting liquid to the distribution piping. When heat from a fire activates a sprinkler, the gas escapes and the dry-pipe valve trips, water enters branch lines, and fire fighting begins as the sprinkler distributes the fluid.

Dry sprinklers may be used where the sprinklers may be exposed to freezing temperatures. NFPA 13 defines a dry sprinkler as a "sprinkler secured to an extension nipple that has a seal at the inlet end to prevent water from entering the nipple until the sprinkler operates." Accordingly, a dry sprinkler may include an inlet containing a seal or closure assembly, some length of tubing connected to the inlet, and a fluid deflecting structure located at the other end of the tubing. There may also be a mechanism that connects a thermally responsive component to the closure assembly. The inlet is preferably secured to a branch line by one of a threaded coupling or a clamp coupling. Depending on the particular installation, the branch line may be filled with fluid (wet pipe system) or be filled with a gas (dry pipe system). In either installation, the medium within the branch line is generally excluded from the passageway of the extension nipple or tubing of the dry sprinkler via the closure assembly in an unactuated state of the dry sprinkler. Upon activation of the thermally responsive component, the dry sprinkler is actuated and the closure assembly is displaced to permit the flow of fluid through the sprinkler.

An automatic sprinkler may be configured for addressing a fire in a particular mode such as for example, control mode or suppression mode. Fire suppression is defined by NFPA 13, Section 3.3.10 as "[s]harply reducing the heat release rate of a fire and preventing its regrowth by means of direct and sufficient application of water through the fire plume to the burning fuel surface." A sprinkler that provides for fire suppression is a suppression mode sprinkler. A suppression mode sprinkler can be "listed" as a sprinkler that has been tested, verified and published in a list by an industry accepted organization, such as for example, FM Global ("FM") and Underwriters Laboratories ("UL") as a sprinkler being suitable for the specified purpose of fire suppression. UL and/or FM test and verify fire suppression performance of a sprinkler by at least installing and subjecting the sprinkler to their respective water distribution test standards: (i) UL Standard for Early-Suppression Fast-Response Sprinklers UL 1767 (2010) and (ii) FM Approval Standard Class No. 2008 (2006).

Accordingly, there are various ways of demonstrating or testing fire suppression capability of a sprinkler. For example, one way of determining the ability of a sprinkler to suppress fire in a stored commodity is by Actual Delivered Density ("ADD") testing and comparison to Required-Delivered-Density ("RDD") values. Briefly, ADD is defined as the amount of water flow over an area (gallons per minute over square feet or "$GPM/ft^2$"), which is actually deposited by a particular sprinkler on top of a combustible package in order to achieve suppression and RDD is the minimum amount of water needed to suppress a particular fire. Suppression capability is believed to be quantifiable, in part, by the concepts of ADD and RDD, as developed by FM Global. Through further developments by FM Global, an ADD test can determine the ADD of a particular sprinkler configuration. The RDD value of a fire of a particular commodity tends to be fixed and therefore is presumed to be known. Under the test suppression criteria, the ADD of a particular sprinkler configuration should be higher than the RDD in order to effectively suppress a particular fire so that it does not spread beyond an initial ignition area.

Another standardized test available for demonstrating fire suppression performance is the water distribution test for Pendent ESFR Sprinklers having nominal K-factors of 14.0 and 16.8 provided under UL 1767 or FM Class Number 2008 (October 2006). Under such tests, a sprinkler can demonstrate suppression capability by delivering a water distribution density that meets or exceeds one or more of the minimum or minimum average fluid density (flow rate per area) criteria. For purposes herein, suppression performance can also be determined for sprinklers having K-factors not listed in the test standards by an appropriate equivalent requirement extrapolated from the available test standards. Suppression performance may be determined by other criteria in addition, or alternative, to the ESFR test standards, such as for example, by the hydraulic design criteria of the sprinkler and more specifically the hose stream demand criteria.

In yet another test, suppression performance of a sprinkler can be determined by actual fire testing, in which a grid of sprinklers are disposed above a storage arrangement in which a fire is ignited to actuate one or more sprinklers in the grid. Under the test criteria, suppression performance can be determined or demonstrated by the resulting number of actuated sprinklers, the maximum temperature of the storage rack over time, and/or progress of the fire in the storage arrangement, for example, containing the fire to the main array of the storage arrangement over the test duration. One or more of the above methods can be utilized to demonstrate that a sprinkler is capable of fire suppression.

Early Suppression Fast Response (ESFR) is defined under NFPA 13, Section 3.6.4.2 as a sprinkler having a thermal sensitivity, i.e., response time index ("RTI") of 50 meter$^{1/2}$ second$^{1/2}$ ("m$^{1/2}$ sec$^{1/2}$") or less and "listed" for its capability to provide fire suppression of specific high-challenge fire challenges. The "RTI" is a measure of thermal sensitivity and is related to the thermal inertia of a heat responsive element of a sprinkler. While ESFR sprinklers can be defined by the RTI of the sprinkler and its performance under the test standards, it should be understood that "suppression" mode sprinklers are not necessarily limited to ESFR sprinklers or sprinklers having an RTI of 50 or less. Accordingly, suppression mode sprinklers satisfying standardized test and/or other suppression criteria may have a thermally sensitive trigger having an RTI of ordinary or standard response sprinklers, i.e., RTI of 80 or greater.

U.S. Patent Publication No. 2009/0294138 shows and describes a dry sprinkler and in particular a dry ESFR sprinkler having a K-factor of 14 or greater. A known ESFR dry sprinkler is shown and described in Viking Technical Data Sheet, entitled "ESFR Dry Pendent Sprinkler VK501 (K14.0)" (Sep. 13, 2012).

DISCLOSURE OF THE INVENTION

A preferred dry sprinkler assembly includes a deflector to provide protection of a rack storage arrangement including cartoned unexpanded Group A plastic commodity having a nominal storage height of at least 20 feet beneath a ceiling with a maximum nominal 40 foot ceiling height. The preferred sprinkler includes an outer structure assembly having an inlet fitting defining an inlet end and an outlet frame defining a distal end, the outlet structure assembly having an internal passageway, an inner structure assembly disposed within the internal passageway, an outlet defining a sprinkler axis. The deflector distributes fluid delivered to the inlet fitting; and in one embodiment is preferably non-planar and in another preferred embodiment, defines a non-circular perimeter. The internal passageway and outlet preferably define a nominal K-factor of at least 16.8 GPM/PSI$^{1/2}$. In one preferred aspect, the sprinkler is configured as a pendent sprinkler.

Another embodiment of the dry sprinkler assembly includes an inlet fitting, a casing, an outlet frame defining a nominal K-factor of 16.8 or greater, an inner structure assembly disposed in the casing; and a deflector coupled to the outlet frame, the deflector that provides for distribution of water fed to the inlet fitting to meet or exceed the minimum and minimum average density criteria for fluid distribution tests of UL Standard for Early-Suppression Fast-Response Sprinklers UL 1767 or FM Approval Standard Class No. 2008.

In yet another embodiment of the dry sprinkler assembly, the assembly has a deflector including a central portion centered about the sprinkler axis and a plurality of tines each extending radially from the central portion to a terminal portion. The plurality of tines preferably include a first pair of diametrically opposed T-shaped tines and a second pair of T-shaped tines disposed orthogonally to the first pair of T-shaped tines. The first pair of tines are preferably aligned in the plane of the pair of arms. In another preferred embodiment of the sprinkler assembly, the preferred deflector has a central portion centered about the sprinkler axis and a plurality of tines each extending radially from the central portion to a terminal portion. The terminal portion of at least two tines of the plurality of tines being angled relative to the central portion such that the terminal portion is axially further away from the outlet frame than the central portion. In an alternate preferred embodiment of the sprinkler assembly, a preferred deflector assembly includes a central portion centered about the sprinkler axis and a plurality of tines extending from the central portion, each tine having a base extending from the central portion, a body extending away from the base, a terminal portion extending from the body having a terminal edge, and a pair of lateral edges extending from the base to the terminal end. The plurality of tines are circumferentially spaced about the central portion to define a plurality of slots therebetween, the lateral edges of circumferentially adjacent tines converging to define an innermost portion of one of the plurality of slots. The innermost portion of each slot defines the shortest radial distance to the sprinkler axis of the radiused end. The outlet frame includes a pair of spaced apart arms preferably disposed about the outlet to define a first plane along which the pair of arms are aligned. The pair of arms define a second plane orthogonal to the first plane about which the pair of arms are disposed. The sprinkler axis is disposed along the intersection of the first and second planes, which dissect the deflector into four quadrants about the sprinkler axis. The innermost portion of each slot in one of the four quadrants define a different radial distance to the sprinkler axis than the other slots in the quadrant. Preferred embodiments of the sprinkler assembly provide a suppression mode sprinkler, and more preferably, an ESFR sprinkler.

An insulating assembly is also provided for an insulated sprinkler installation for a sprinkler assembly penetrating between and interior and an exterior of an occupancy separated by a surface. The insulating assembly includes a split insulation ring, a housing defining a first slot for engaging a sprinkler casing; and an insert member including a second slot disposed between the insulation ring and the housing. The first and second slots are axially aligned with one another and the split is disposed orthogonally with respect to the first and second slots.

BRIEF DESCRIPTIONS OF THE DRAWINGS

The accompanying drawings, which are incorporated herein and constitute part of this specification, illustrate exemplary embodiments of the invention, and, together with the general description given above and the detailed description and attachments given below, serve to explain the features of the invention.

FIGS. 6B-6F are cross-sectional views of the deflector illustrated in the plan view of FIG. 6A.

DETAILED DESCRIPTION OF THE PREFERRED EMBODIMENTS

Figure 1:
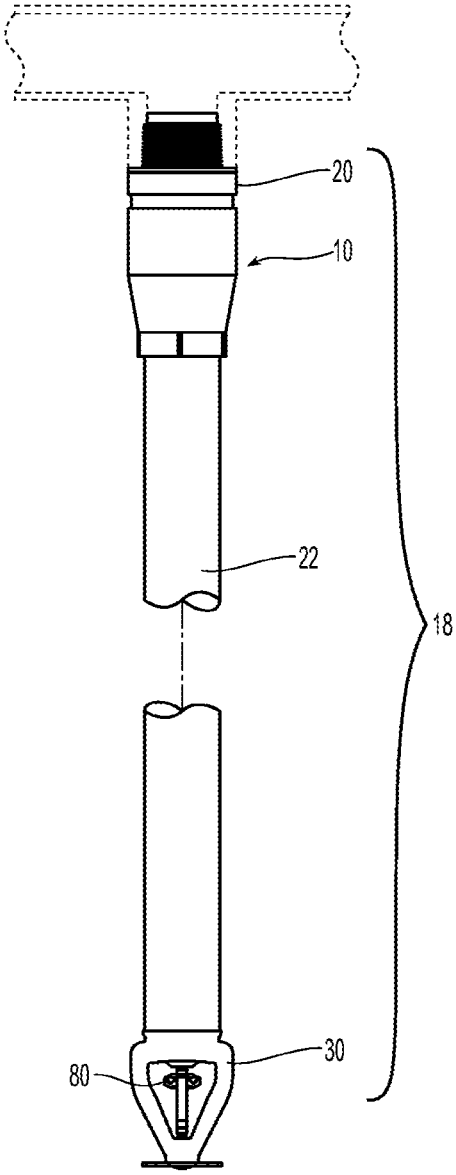
FIG. 1 illustrates a dry sprinkler assembly using a threaded connection with a fluid supply pipe.
Figure 2:
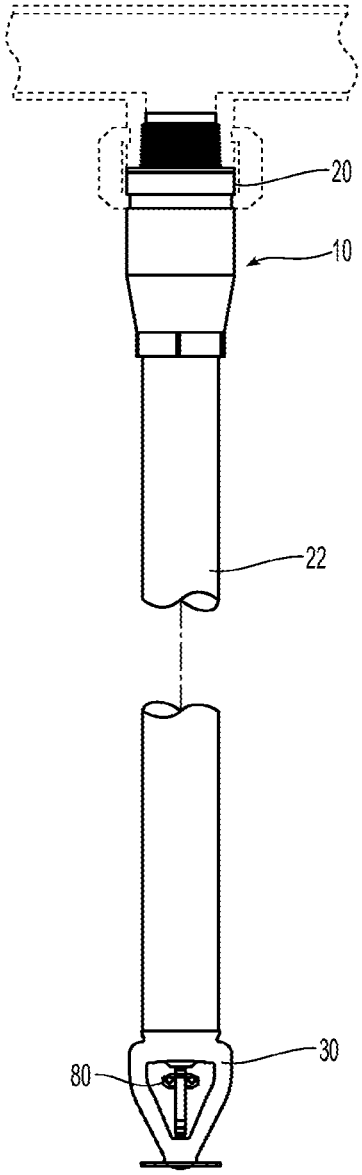
FIG. 2 illustrates a grooved-type coupling connection of the sprinkler assembly of FIG. 1 using a groove-type coupling.
Figure 3A:
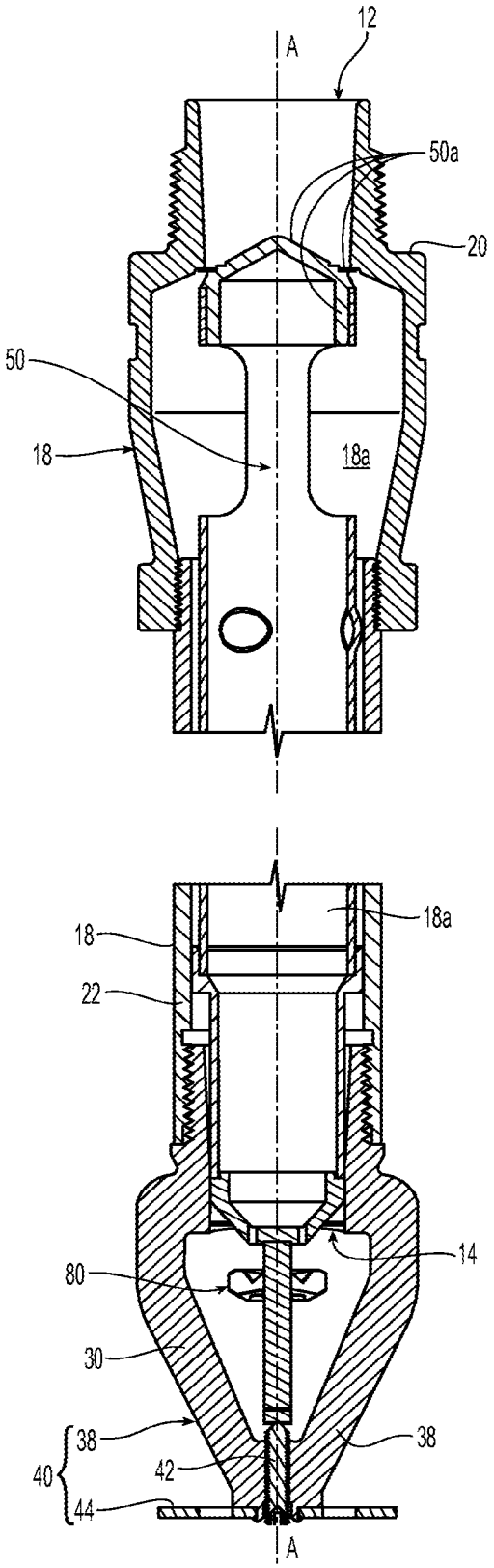
FIG. 3A is a cross-sectional view of the sprinkler assembly of FIGS. 1 and 2 in an unactuated state.
Figure 3B:
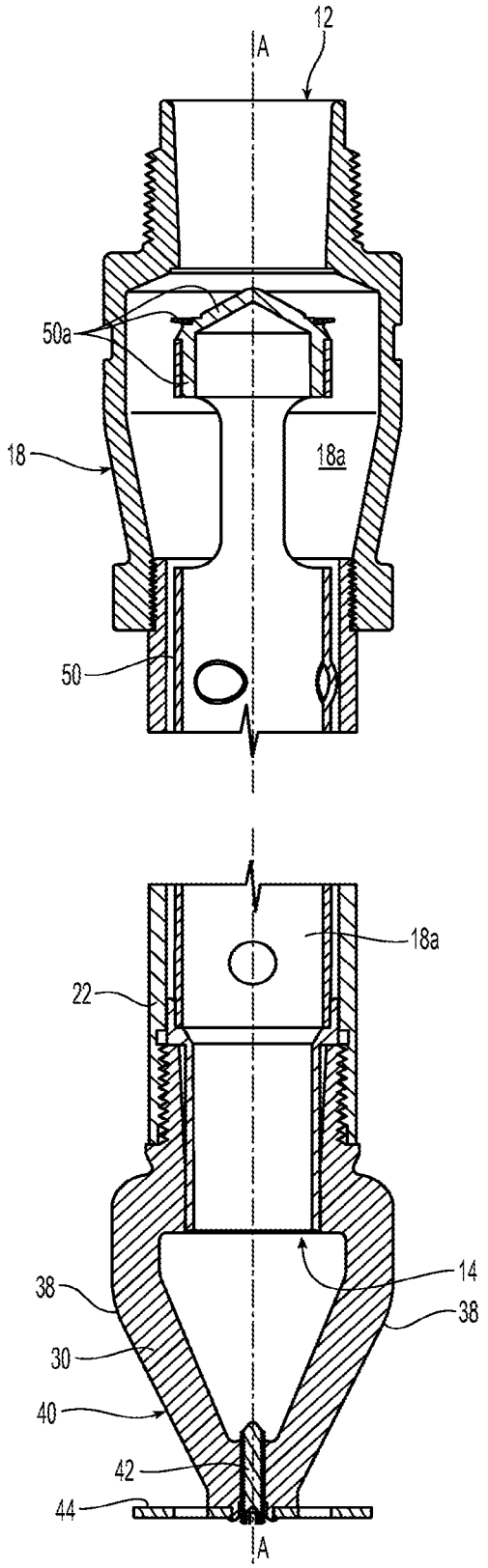
FIG. 3B is a cross-sectional view of the sprinkler assembly of FIG. 1 in an actuated state.

FIGS. 1 and 2 illustrate a preferred embodiment of a dry sprinkler 10 installed and coupled to a pipe fitting of a piping network, which is supplied with a fire fighting fluid, e.g., fluid from a pressurized fluid supply source. The preferred embodiments described herein, that include dry sprinklers that are preferably used in a wet pipe system (e.g. the entire system is not exposed to freezing temperatures in an unheated portion of a building), may be used for example, with a dry pipe system (e.g. at least a portion of the system is not exposed to freezing temperatures in an unheated portion of a building) or both. Fluid supply piping systems may be installed in accordance with the NFPA 13. As seen in FIGS. 3A and 3B, the dry sprinkler 10 includes an outer structure assembly 18, an inner structural assembly 50, and a thermal trigger 80. The outer structure assembly 18 defines an internal passageway 18*a* that extends along a central longitudinal sprinkler axis A-A between a proximal inlet end 12 and a distal outlet end 14. The outer structure assembly 18 preferably includes an inlet fitting 20 at the proximal end, an outlet frame 30 defining the sprinkler outlet at the distal outlet end 14 with a casing tube 22 preferably in between coupling the inlet fitting 20 to the outlet frame 30. In a preferred embodiment of the dry sprinkler, the sprinkler outlet frame 30 and outlet define a preferred discharge coefficient or K-factor defining a nominal K-factor of 16.8. However, other nominal K-factors greater than 16.8 can be achieved. The inner structural assembly 50 includes a closure assembly 50*a* disposed within the inlet fitting 20 for controlling the flow fluid through the internal passageway 18*a*. The inlet fitting 20 is preferably configured, as shown respectively in FIGS. 1 and 2, for coupling to the pipe fitting by either a threaded or grooved-type coupling.

A free end of the outlet frame 30 can include at least one frame arm 38 that is coupled to a fluid deflecting structure 40. Preferably, the outlet frame 30 and frame arm 38 are formed as a unitary member. The outlet frame 30, frame arm 38, and fluid deflecting structure 40 can be made from rough or fine casting, and, if desired, machined. Referring to FIG. 3A, the fluid deflecting structure 40 can include an adjustment screw 42 and a planar surface member 44 coupled to the frame arm 38 and preferably fixed at a spaced axial distance from the outlet frame 30. Accordingly, as shown, the preferred outlet frame 30 and deflecting structure 40 provide for a pendent dry sprinkler configuration. The exemplary planar surface member 44 is configured to deflect the fluid flow to form an appropriate spray pattern. Instead of the illustrated planar surface member 44, other configurations could be employed to provide the desired fluid deflection pattern, such as for example, the deflector 100 described below. The adjustment screw 42 is provided with external threads that can be used to adjust an axial spacing between the inner structural assembly 50 and the thermal trigger 80 such that that the thermal trigger 80 supports the inner structural assembly in the unactuated state of the sprinkler of FIG. 3A. The adjustment screw 42 preferably includes a seat portion that engages the thermal trigger 80. Although the adjustment screw 42 and the planar surface member 44 have been described as separate parts, they can be formed as a unitary member. Upon thermal actuation and release of the trigger 80, the inner structural assembly 50 slides axially to an actuated state of the sprinkler as shown in FIG. 3B to permit the flow of fluid or water through the internal passageway 18*a* and out the outlet at the distal end 14. In one preferred embodiment, the trigger 80 preferably defines a thermal sensitivity or RTI of 80 $meter^{1/2}$ $second^{1/2}$ or less and preferably 50 $meter^{1/2}$ $second^{1/2}$ or less. More preferably, when the sprinkler 10 is configured as an ESFR sprinkler, the trigger 80 preferably defines an RTI ranging between 19 and 36 $meter^{1/2}$ $second^{1/2}$.

International PCT Patent Application No. PCT/US12/44704, filed Jun. 28, 2012, having International Patent Application Publication No. WO2013003626, entitled "Dry Sprinkler Assemblies" is incorporated by reference herein in its entirety and provides further details regarding a preferred embodiment of a dry sprinkler sub-assembly. Other dry sprinkler sub-assemblies for use in a preferred dry sprinkler are shown and described in U.S. Pat. Nos. 7,516,800 and 7,559,376, both of which are incorporated by reference herein in their entireties.

Figure 4A:
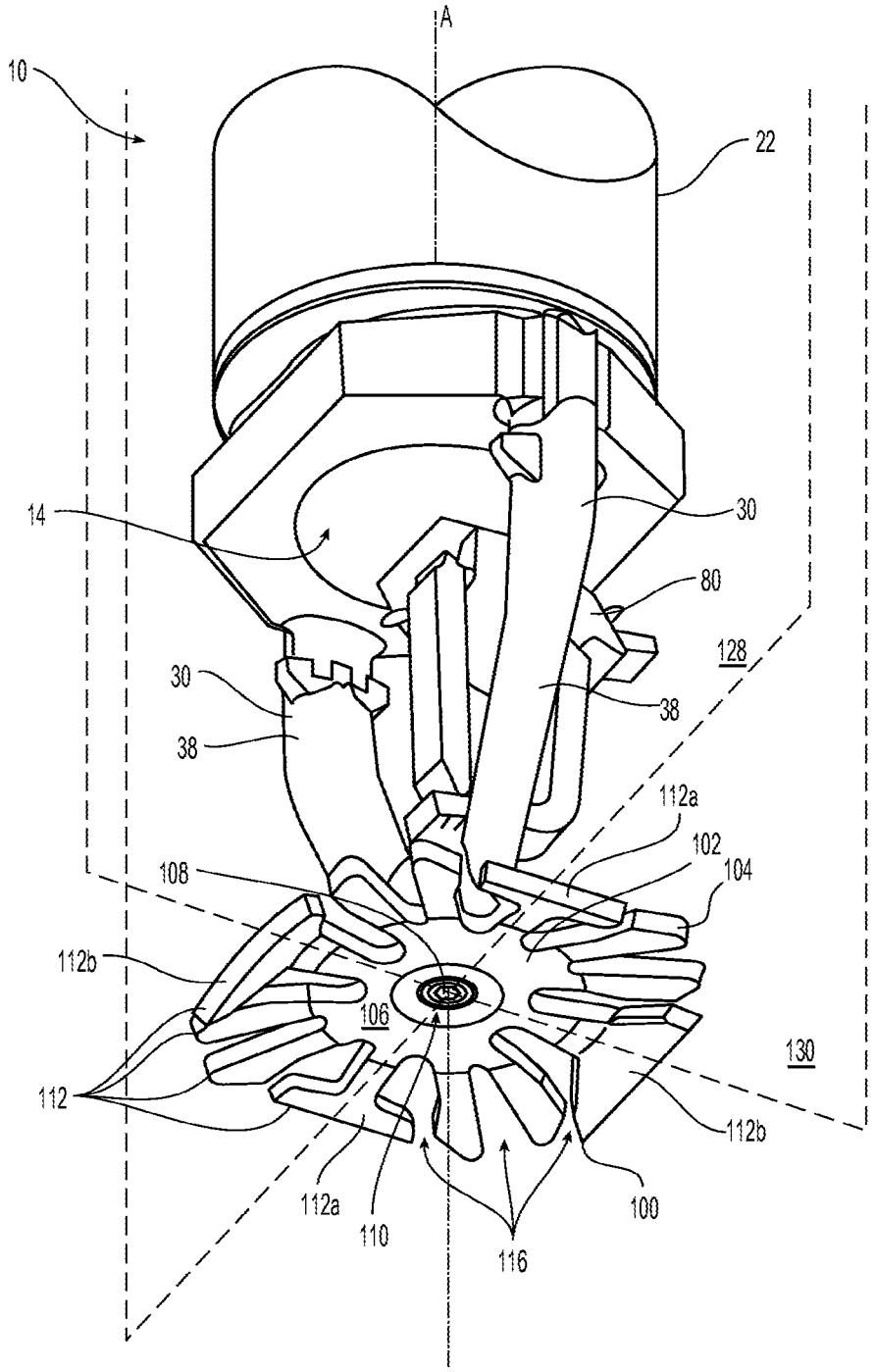
FIG. 4A is an isometric view of a sprinkler assembly with a preferred deflector.
Figure 4B:
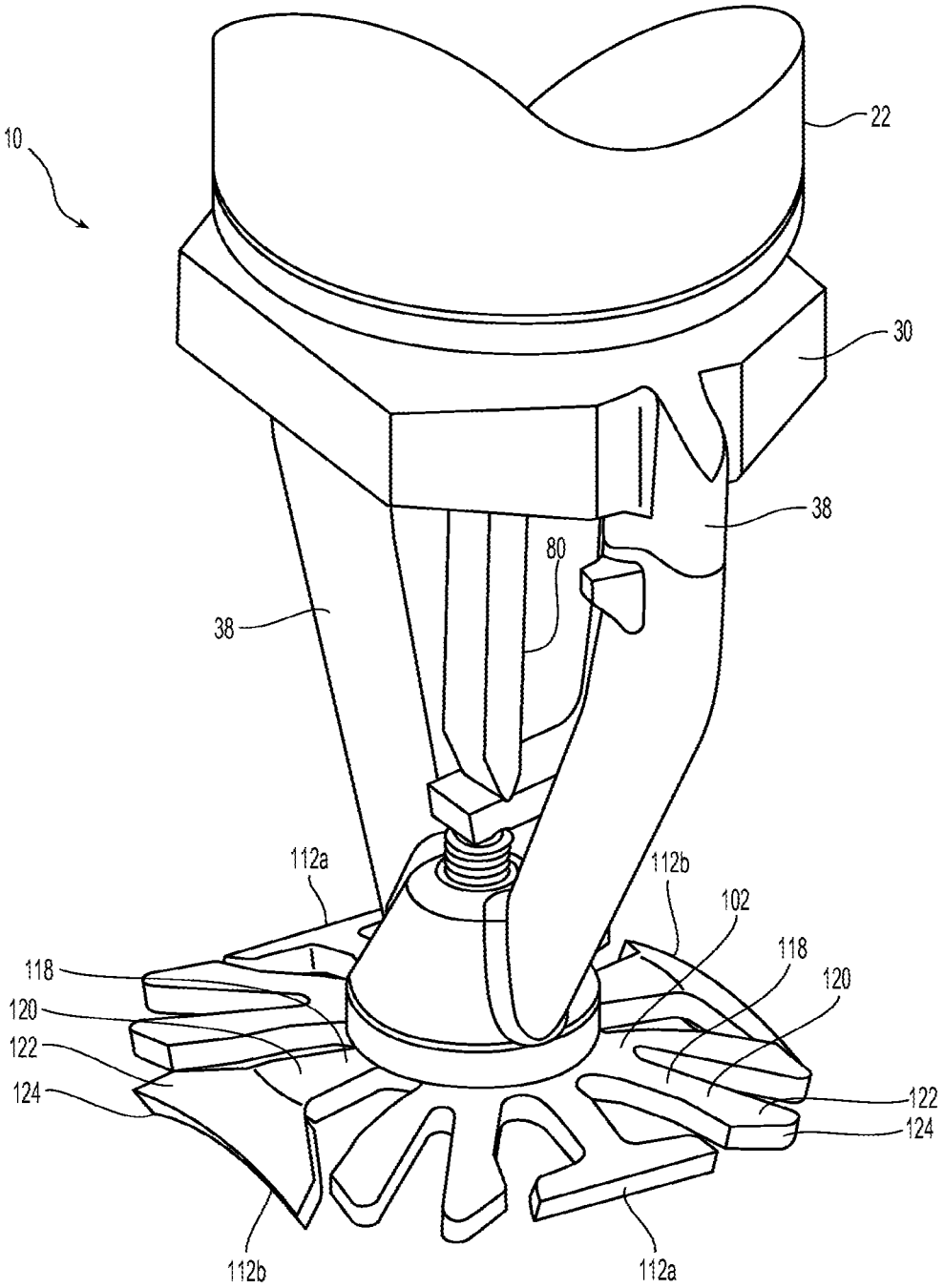
FIG. 4B is an alternative isometric view of the sprinkler assembly of FIG. 2.

The aforementioned and described sprinkler assemblies can be used with a preferred deflector having a non-planar surface. As illustrated in FIGS. 4A-4B, the preferred deflector 100 is composed of a plate with a uniform plate thickness. The deflector 100 preferably has a central portion 102 and a peripheral portion 104 disposed about the central portion 102. The central portion 102 has a central planar surface 106 and defines a center point 108 of the deflector 100 though which the sprinkler axis A-A passes when the deflector 100 is coupled to the frame arm 38. The central portion 102 includes a mounting hole 110 that is centered on the center point 108 and sized and positioned to engage the frame arm 38 to hold the deflector 100 at a fixed position and orientation relative to the frame arm 38. When the deflector 100 is coupled to the frame arm 38 and in the fixed position, the central planar surface 106 of the central portion 102 is disposed orthogonal to the sprinkler axis A-A.

The peripheral portion 104 of the deflector 100 is preferably defined by the plurality of tines 112 disposed about the central portion 102 of the deflector 100 with spacing between adjacent tines 112 to define the deflector slots 116. Each tine 112 preferably defines a base 118 extending from the central portion 102, a body 120 extending radially away from the base 118, and a terminal portion 122 extending from the body 120 that ultimately ends at the terminal end surface 124 of the tine.

A preferred outlet frame 30 and deflector 100 arrangement is provided for distribution of water for suppression performance, preferably ESFR ("Early Suppression Fast Response") performance and more preferably ESFR performance which satisfies industry accepted ESFR fluid distribution standards as described in greater detail below and noted above. More specifically the tines are configured and arranged in a manner with respect to the frame arms to provide for the preferred water distribution performance. With reference to FIGS. 4A and 4B, the preferred outlet frame 30 includes two spaced apart arms 38 diametrically opposed about the sprinkler outlet 14 such that the arms 38 define a first plane 128 that includes the sprinkler axis A-A. The preferred deflector 100 is preferably affixed to the outlet frame 30 and defines a plurality of tines 112 and more preferably defines a plurality of groups of tines 112, and even more preferably includes a first group, second group, third group and at least fourth group of tines. In one preferred embodiment, a first group or pair of "T-shaped" tines 112*a* are diametrically opposed about the mounting hole 110 and aligned with the first plane 128 such that the first plane 128 bisects each tine of the first pair of T-shaped tines 112*a*. The deflector 100 and tines 112 preferably include a second group or pair of T-shaped tines 112*b* that are diametrically opposed about the mounting hole 110 and disposed orthogonally to the first pair of T-shaped tines 112*a* so as to be aligned with and bisected by a second plane 130 that is perpendicular to the first plane 128 with the sprinkler axis A-A defining the intersection of the first and second planes 128, 130. In a preferred embodiment of the deflector 100, it is believed that the surfaces provided by at least the T-shaped tines is a factor that facilitates the generation of a spray pattern and volume that conforms with industry standards, such as for example, to satisfy the ESFR distribution requirements under FM Approval Standard Class No. 2008 and/or UL 1767.

Figure 5:
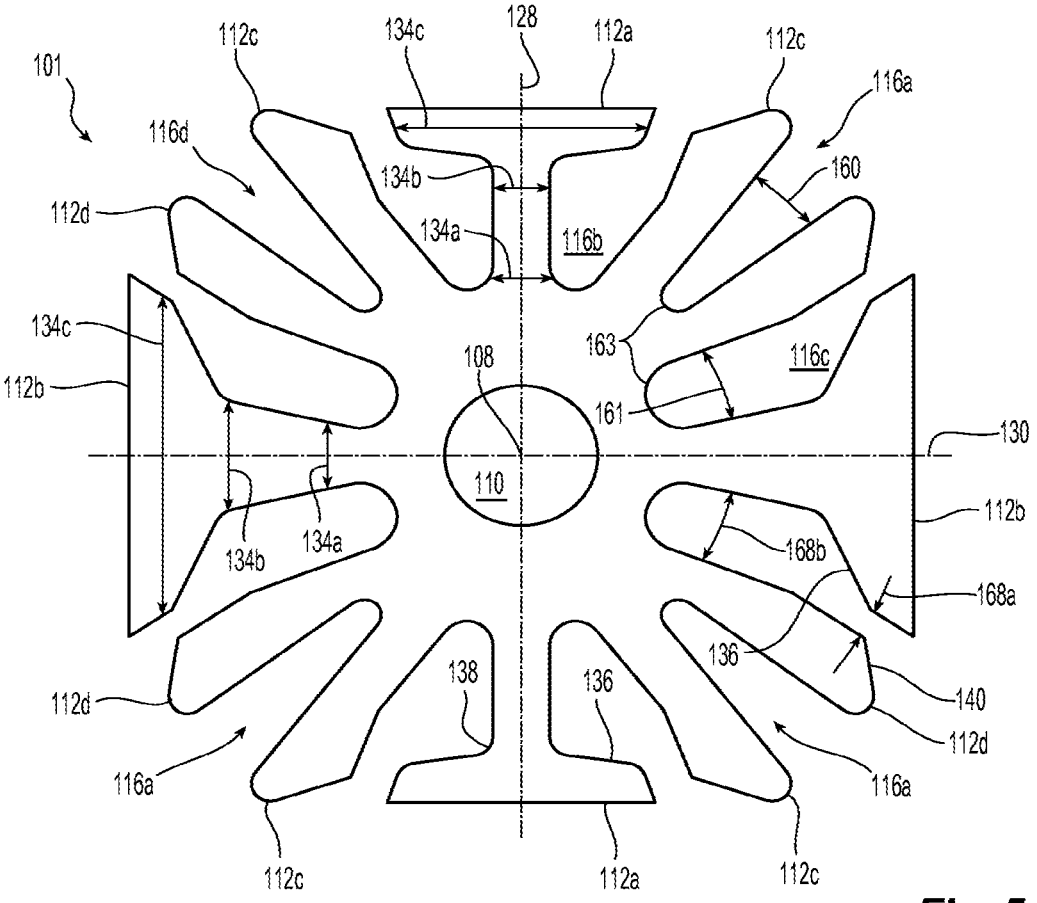
FIG. 5 is a plan view of a blank used to form the preferred deflector of FIG. 2.

FIG. 5 illustrates a plan view of a flat blank 101 used to form the preferred deflector 100. As can be appreciated and as explained below, during manufacture the blank 101 is subsequently bent to form the preferred deflector 100 and, accordingly, has characteristic and dimensions that are identical and/or similar to the preferred deflector 100. Accordingly, the following description and reference numerals associated with the blank 101 illustrated in FIG. 5 are fully applicable to the preferred deflector 100 described elsewhere in this description and shown in other drawings such as FIGS. 4A-4B and 6A-6F, except where differences are noted. As can be seen in FIG. 5, the second pair of T-shaped tines 112*b* preferably define a larger deflector surface area as compared to the first pair of T-shaped tines 112*a*. Between the first pair of T-shaped tines 112*a* and the second pair of T-shaped tines 112*b*, in a circumferential direction about the sprinkler axis A-A, are third tines 112*c* and fourth tines 112*d* disposed radially adjacent to each other to define an first slot 116*a* therebetween. More preferably, the third tines 112*c* and fourth tines 112*d* are arranged with respect to planes 128 and 130 so as to define a first group of slots 116*a*, forming two sets of slot pairs diametrically opposed about the mounting hole 110 and substantially aligned at a 45-degree angle relative to the first and second planes 128, 130.

In the preferred arrangement of the deflector 100, as illustrated in the plan view of the blank 101 of FIG. 5, there are only two tines circumferentially disposed between a first T-shaped tine 112*a* and a second T-shaped tine 112*b* to define so as to define a third group of tines 112*c* and a fourth group of tines 112*d* with additional slots formed therebetween. More preferably, a first T-shaped tine 112*a* and a third group tine 112*c* define a second group of slots 116*b* therebetween, and a second T-shaped tine 112*b* and a fourth tine 112*d* define a third group of slots 116*c* therebetween. In one embodiment, the tines 112 and slots 116 altogether preferably define a tine pattern 126 about the sprinkler axis A-A. The preferred tine pattern 126 includes twelve tines 112 (includes tines 112*a*, 112*b*, 112*c*, and 112*d*) radially spaced about the central portion 102 to define twelve deflector slots 116 (including slots 116*a*, 116*b*, and 116*c*) with each slot 116 circumferentially disposed between two adjacent tines 112.

Referring to FIGS. 4A, 4B and 6A-6F, the tines of the preferred deflector 100 are preferably formed such that the tines 112 are angled with respect to the central planar surface 106 at the central portion 102 and, more preferably, angled in a direction away from the sprinkler outlet 14 to define a bend line transition preferably between the central portion 102 and the base portion 118 of each tine 112. Still more preferably, the preferred deflector 100 has tines 112 that are disposed at different angles. In one preferred aspect, the tines may be angled away from the central portion 102 such that one tine 112 defines an included angle with respect to the central portion 102 that is different than the included angle defined by another tine with respect to the central portion of the deflector 100. Moreover, as described in greater detail below, each tine may be formed in a manner such that one or more groups of tines define water deflecting and distribution surfaces and edges that collectively deflect and distribute water in a manner for satisfactory fire protection, preferably suppression fire protection and more preferably in a manner that satisfies water distribution industry standards for ESFR protection and even more preferably suppression and/or ESFR protection for a stored commodity. The tines 112 preferably includes lateral edges which progress radially from the central portion 102 of the deflector. Lateral edges of radially adjacent tines define the slot therebetween for water distribution. For example, the tines 112 may include one or more curved surfaces so as to present one of a concave or convex surface to the water flow from the sprinkler outlet 14. Moreover, circumferentially-adjacent tines preferably include lateral edges which diverge away and/or converge toward one another so as to define a slot therebetween that varies in width over the slot length in a manner to facilitate the preferred water distribution. At the radially innermost portion of the slots, the lateral edges preferably converge to define a radiused end of the slot to define a tangential point defining the shortest radial distance to the sprinkler axis A-A. The radial length of each slot may vary such that the terminal points at the innermost portion of the slots vary their radial distance from slot to slot. Preferably, each quarter or quadrant of the deflector defined by the first and second planes 128, 130 preferably includes slots of the first, second and third groups 116*a*, 116*b*, 116*c* having a radial innermost portion disposed at different radial distances from the sprinkler axis A-A. At the radially outward or terminal ends of the tines are tine edges which, although linear or rounded, collectively define the general perimeter of the deflector such as, for example, a non-circular perimeter. More specifically, the terminal end surfaces 124 of each of the plurality of tines 112 include a tine edge, each of which defines a radial distance from the sprinkler axis. The radial distances of the tine edges vary from the sprinkler axis such that the tine edges approximate a non-circular perimeter, such as for example, a rectangle, a square, a hexagon, other polygon or oval.

Again referring to FIGS. 5 and 6A and the plan view of deflector 100, each of the tines 112 preferably become broader and/or wider in the radial direction away from the sprinkler axis A-A. When referring to the width of any portion of the slots or tines, it is preferably measured as the distance between two points of the slot or tine projected onto a common line disposed in a plane orthogonal to the sprinkler axis A-A in which the common line is perpendicular to a plane substantially bisecting the tine or slot. Moreover, the plurality of slots 116 includes at least one group of slots in which its slot width narrows in the radial direction away from sprinkler axis A-A and more preferably further includes at least one group of slots in which the slot width become wider in the radial direction away from the sprinkler axis A-A. Even more preferably, the group of slots that become wider in the radial direction away from the sprinkler axis A-A are the slots 116*a* first 116*a* axially aligned at 45-degrees relative to the first and second planes 128, 130. Accordingly, in one aspect of the subject dry sprinkler having a preferred deflector 100, the described preferred slot groupings are defined by a plurality of tines which include orthogonally disposed paired T-shaped tines 112*a*, 112*b* with one pair of tines 112*a* aligned with the frame arms 38 of the outlet frame 30 as seen in FIGS. 4A and 4B. The plurality of tines 112 further include a radial outward or terminal portion with each tine angled from the central portion 102 of the deflector and axially away from the sprinkler outlet 114 so to present a substantially convex deflector surface to the fluid flow exiting from the sprinkler outlet 114. Disposed circumferentially adjacent to each of the T-shaped tines 112*a*, 112*b* are tines 112 having lateral edges that converge or diverge accordingly from the T-shaped tines to define the preferred grouping of slots as previously described and as shown in FIG. 5. The preferred orthogonally-disposed pairs of T-shaped tines 112*a*, 112*b* include linear edges at their radial or terminal end surfaces 124 which give the preferred deflector a substantially rectangular perimeter.

Further described herein below are features of the subject deflector which in combination provide for the preferred embodiments of the dry sprinkler and deflector arrangements described herein. Again referring to FIG. 5, the preferred tine pattern 126 also has symmetry about one or more planes disposed on the sprinkler axis A-A and bisecting the deflector 100. Preferably, two frame arms 38 engaging the deflector 100 define the first plane 128 disposed on the sprinkler axis A-A to bisect each of the two frame arms 38 and define a second plane 130 disposed on the sprinkler axis A-A orthogonally to the first plane 128 to dispose one frame arm 38 on each side of the second plane 130. As illustrated in FIG. 5, the first and second planes 128, 130 each bisect the deflector 100 to divide or define quadrants or quarter segments 132 of the deflector and preferred tine pattern 126 that has in each quarter segment 132 two full tines 112*e*, 112*d* disposed between two bisected tines 112*a*, 112*b*. The two bisected tines 112*a*, 112*b* are symmetrical tines because each tine 112*a*, 112*b* is bisected by and symmetrical about the first or second planes 128, 130 defining the edges of the quarter segment 132. The two full tines 112*c*, 112*d* of the quarter segment 132 are disposed between the two bisected tines 112*a*, 112*b*, and are asymmetrical because each full tine 112*c*, 112*d* is not symmetrical about a plane disposed on the sprinkler axis A-A. Preferably, the symmetrical (bisected) tines 112*a*, 112*b* and the asymmetrical (full) tines 112*c*, 112*d* of the preferred tine pattern 126 present a repeating pattern having two asymmetrical tines 112*e*, 112*d* followed by a single symmetrical tine (112*a* or 112*b*) about the center point 108 of the deflector. Also, the preferred twelve-tine pattern 126 includes a total of four symmetrical tines 112*a*, 112*b* and eight asymmetrical tines 112*c*, 112*d*.

Figure 6A:
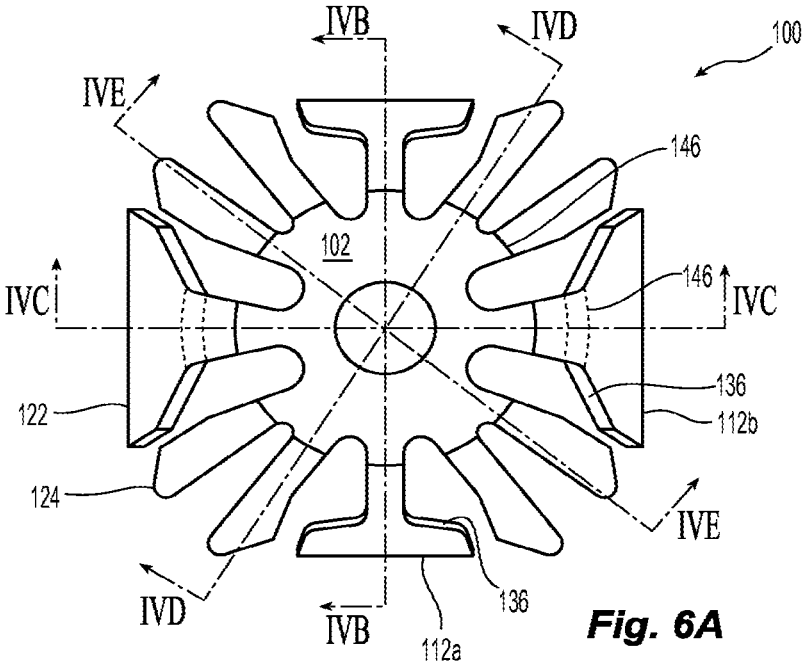
FIG. 6A is a plan view of the preferred deflector of FIG. 2.

The preferred tine pattern 126 includes two types of symmetrical tines 112*a*, 112*b* and two types of asymmetrical tines 112*c*, 112*d* that are repeated to provide the twelve tines 112 of the tine pattern 126. In a preferred embodiment, the two types of symmetrical tines 112*a*, 112*b* each have a "T-shaped" that presents a tine width 134 that has a first tine width 134*a* and a second tine width 134*b* at the tine base 118 or tine body 120, and a third tine width 134*c* at the tine terminal portion 122 that is greater than the first or second tine widths 134*a*, 134*b*. Referring to FIGS. 5 and 6A, this increase in tine width 134 between the third tine width 134*c* and the first or second tine widths 134*a*, 134*b* is preferably sufficient to present inwardly-facing tine edge surfaces 136 (as illustrated in FIG. 6A) of the tine terminal portion 122 on each side of the tine 112*a*, 112*b* that face inwards towards the center point 108 of the deflector 100. Preferably, the third tine width 134*c* at the terminal portion 122 is greater than an addition of the first and second tine widths 134*a*, 134*b*. Also, the second tine width 134*b* of each symmetrical tine 112*a*, 112*b* are either the same or the second tine width 134*b* is greater than the first tine width 134*a*. Preferably, the inwardly-facing tine edge surfaces 136 are located at a transition area 138 of the tine 112*a*, 112*b* that includes a portion of the tine having a radial length extending from the second tine width 134*b* to the third tine width 134*c*. Also preferably, with reference to FIGS. 2 and 6B, the inwardly-facing tine edge surfaces 136 of the second T-shaped tine 112*b* include an inwardly-facing edge surface with a rounded profile portion 137 that presents a curved edge to the surface 136. Alternatively, any edge of the deflector 100 can have a rounded profile.

In the preferred tine pattern 126, the two types of symmetrical tines 112*a*, 112*b* are small "T-shaped" tines 112*a* and large "T-shaped" tines 112*b*. Preferably, the small T-shaped tines 112*a* are disposed on the first plane 128 and the large T-shaped tines 112*b* are disposed on the second plane 130. Preferably, the small T-shaped tines 112*a* each have a tine body 120 with first and second tine widths 134*a*, 134*b* that are equal, and the large T-shaped tines 112*b* each have a tine body 120 with a second tine width 134*b* that is greater than a first tine width 134*a*. Also preferable are a small T-shaped tine 112*a* or a large T-shaped tine 112*b* that has a terminal portion 122 with a radial tine length disposed on the first or second plane 128, 130 that is approximately equal to the second tine width 134*b* of the tine body 120. Also preferable are a small T-shaped tine 112*a* terminal end surface 124 that is planar and orthogonal to the first plane 128 passing through the tine 112*a*.

The preferred two types of asymmetrical tines 112*c*, 112*d* are "small-T-facing" tines 112*c* and "large-T-facing" tines 112*d* so designated because an asymmetrical extending portion 140 of these tines 112*c*, 112*d* extends in an arcuate direction centered about the center point 108 towards either the small or large T-shaped tines 112*a*, 112*b*. For each asymmetrical tine 112*c*, 112*d*, this extending portion 140 is preferably defined by an edge 142 of the asymmetrical tine 112*c*, 112*d* that is non-planar in the radial direction from the center point 108. Preferably, the non-planar edge 142 defining the extending portion 140 is planar proximate to the tine base 118 and becomes non-planar radially away from the tine base 118. An opposing edge 144 on the other side of the asymmetrical tine 112*c*, 112*d* is preferably planar in that it presents a flat surface extending along the tine body 120 from the tine base 118 to the tine terminal portion 122. Preferably, one small-T-facing tine 112*c* and one large-T-facing tine 112*d* are disposed between two symmetrical tines 112*a*, 112*b* in a repeating tine pattern about the deflector center point 108. Alternatively, the tines may be small-T-facing, large-T-facing, or a combination thereof.

Referring to FIGS. 6A-6E, each symmetrical tine 112*a*, 112*b* and asymmetrical tine 112*c*, 112*d* includes a bend portion 146 at which the tine 112 is angled to bend away from the frame arms 38. The bend portion 146 is disposed at the tine base 118 or between the tine base 118 and the tine terminal portion 122. Preferably, the central planar surface 106 extends radially outward from the central portion 102 to meet the bend portion 146 of each tine 112. The bend portion 146 is a deformation of the deflector plate that disposes at least a surface of the tine terminal portion 122 at an angle 148 relative to central planar surface 106 so that the tine 112 is at least in part bent outwards away from the frame arms 38. The bend portion 146 is preferably a single bend 146 of the deflector plate forming the tine 112. On the asymmetrical tines 112*c*, 112*d* and the small T-shaped symmetrical tine 112*a*, the bend portion 146 is preferably proximate to the tine base 118, between the tine base 118 and the tine body 120, or on an end of the tine body 120 engaging the tine base 118, and is more preferably disposed about the center point 108 at a diameter of approximately one inch. On the large T-shaped symmetrical tine 112*b*, the bend portion 146 is preferably at an end of the tine body 120 engaging the tine terminal portion 122, positioned to include engaging ends of the tine body 120 and the tine terminal portion 122, or on an end of the tine terminal portion 122 engaging the tine body 120, and is more preferably disposed about the center point 108 at a diameter of approximately one inch to about 1.25 inches. The small T-shaped tine 112*a* has a bend portion 146 that disposes a surface of the tine at an angle 148*a* of approximately 9.0-20.0 degrees relative to the central planar surface 106 of the central portion 102 and, more preferably, an angle 148*a* of approximately 9.0-17.0 degrees. The large T-shaped tine 112*b* has a bend portion 146 that disposes a surface of the tine at an angle 148*b* of approximately 30.0-40.0 degrees relative to the central planar surface 106 of the central portion 102 and, more preferably, an angle 148*b* of approximately 35.0 degrees. The small-T-facing tine 112*c* has a bend portion 146 that disposes a surface of the tine at an angle 148*c* of approximately 5.0-15.0 degrees relative to the central planar surface 106 of the central portion 102 and, more preferably, an angle 148*c* of approximately 10.0 degrees. The large-T-facing tine 112*d* has a bend portion 146 that disposes a surface of the tine at an angle 148*d* of approximately 5.0-15.0 degrees relative to the central planar surface 106 of the central portion 102 and, more preferably, an angle 148*d* of approximately 10.0 degrees. As can be appreciated, each tine of the preferred tine pattern is disposed at a different angle 146 than an adjacent tine. It is believed that the varying angulation of the tines is a factor that facilitates the generation of a spray pattern and volume that conforms with industry standards. As can also be appreciated, each quarter segment 132 of the preferred tine pattern 126 has tines that are disposed at different angles 146 from each other.

It should be understood that the stated dimensional values and approximations thereof are preferred embodiments. Accordingly, the relative angles between tines may be varied so as to provide for the desired water distribution. For example, the angle 146 of the small-T-facing tine 112*c* can be approximately the same as the angle 146 of the large-T-facing tine 112*d*. The inventor believed that the preferred angles and/or the variability in angles from tine to tine facilitated water distribution so as to provide satisfactory performance under the industry-accepted standards, such as for example, the Actual Delivered Density tests of UL 1767 (2010) and the water distribution tests of FM Approval Standard Class No. 2008 (October 2006). Referring to FIGS. 6A-6F, the asymmetrical tines 112*c*, 112*d* and the small T-shaped tines 112*a* preferably have planar surfaces 150 radially outward from the bend portion 146. Preferably, the large T-shaped tines 112*b* have arcuate surfaces 152 radially outward from the bend portion 146 that are curved about a center 154 located in a direction downstream of the sprinkler 10 so as to present a convex surface 156 to the flow of water from the activated sprinkler, as illustrated in FIGS. 4B and 6F. Preferably, a distance between the center 154 and a surface of the tine 112*b* of the terminal portion 122 of the large T-shaped tine 112*b* is approximately 1.5 inches.

Referring to FIGS. 5-6E, the spacing between the tines of the preferred tine pattern 126 define a plurality of slots 116. Preferably between adjacent small-T-facing tines 112*c* and large-T-facing tines 112*d*, an angled slot 116*a* is defined that has linear opposing surfaces 144 that are disposed at an angle 160 to each other to converge together at an inner curved surface 163 of the slot 116*a*. Preferably, the tine pattern 126 has four angled slots 116*a* distributed about the center point 108 of the deflector. In the preferred tine pattern there are eight slots 116*b*, 116*c*. Each of the eight slots 116*b*, 116*c* are defined by opposing surfaces extending along a length of the slot from the base 118 to the terminal portion 122 with a surface 162 on one side of the slot and an opposing surface 162 on an opposing side of the slot, with the surface 162 and opposing surface 162 disposed at an angle 161 to each other to converge together at an inner curved surface 163. Preferably, an open end of each of the eight slots 116*b*, 116*c* are in part defined by an angled surface 166 of the terminal portion 122 of the small T-shaped tine 112*a* or large T-shaped tine 112*b* that is disposed toward the opposing surface 142 of the asymmetrical tine defining the slot 116*b*, 116*c*, with the angled surface 166 positioned to cause the slot 116*b*, 116*c* to narrow in a radial-outward direction until the slot terminates at an open end of the slot. Preferably, for the small T-shaped tine 112*a* and large T-shaped tine 112*b*, a first slot width 168*a* between an surface 166 of the terminal portions of the small T-shaped tine 112*a* or large T-shaped tine 112*b* and an opposing edge 142 of the corresponding asymmetrical tine 112*c*, 112*d* is less than a second slot width 168*b* between opposing slot surfaces at edges 162 located radially inward from the first slot width 168*a*. As can be appreciated, the bend portion angles 148 and 148*a* of the tines 112 provide slots 116 where the opposing surfaces of each slot are not entirely on the same plane or entirely opposite to each other, resulting in an offset between surfaces of adjacent tines or between any two tines of the deflector 100. Preferably, the offset will define a first distance 170*a* between the central planar surface 106 and a surface of the tine, and another offset will define a second distance 170*b* between the central planar surface 106 and a surface of another tine. Accordingly, one of the distances 170*a*, 170*b* may be greater than the other. The inventor believed that the T-shaped tines, and more particularly the small T-shape tines and features thereof facilitated water distribution so as to provide satisfactory performance under the industry-accepted standards, such as for example, the Actual Delivered Density (ADD) tests of UL 1767, Section 30 (2010) and more particularly the water distribution tests of FM Approval Standard Class No. 2008 (October 2006), including the "under 1" sprinkler water distribution tests. The various water distribution tests and the results for the preferred sprinkler are described in greater detail below.

The preferred sprinkler and deflector were subjected to water distribution testing conforming with the following industry-accepted standards: (i) the water distribution tests of Section 4.29 of FM Approval Standard Class No. 2008 (October 2006); (ii) the water distribution tests of Section 45 of UL 1767, entitled "Distribution Tests for Pendent ESFR Sprinklers Having a Nominal K-factor of 14.0 or 16.8"; and (iii) the Actual Delivered Density tests of UL 1767, Section 30, entitled "Actual Delivered Density (ADD) Test for Pendent ESFR Sprinklers Having a Nominal K-factor of 14.0 or 16.8" (2010). The dry sprinkler assembly with the preferred deflector 100 is suitable to satisfy each requirement of each of the FM sprinkler water distribution tests provided under Section 4.29 entitled "Water Distribution (ESFR K14.0 and K16.8 Pendent Sprinklers Only)"). As such, the dry sprinkler assembly with the preferred deflector 100 is also suitable to satisfy each requirement of the UL water distribution test requirements at Section 45 of UL 1767.

Figure 7:
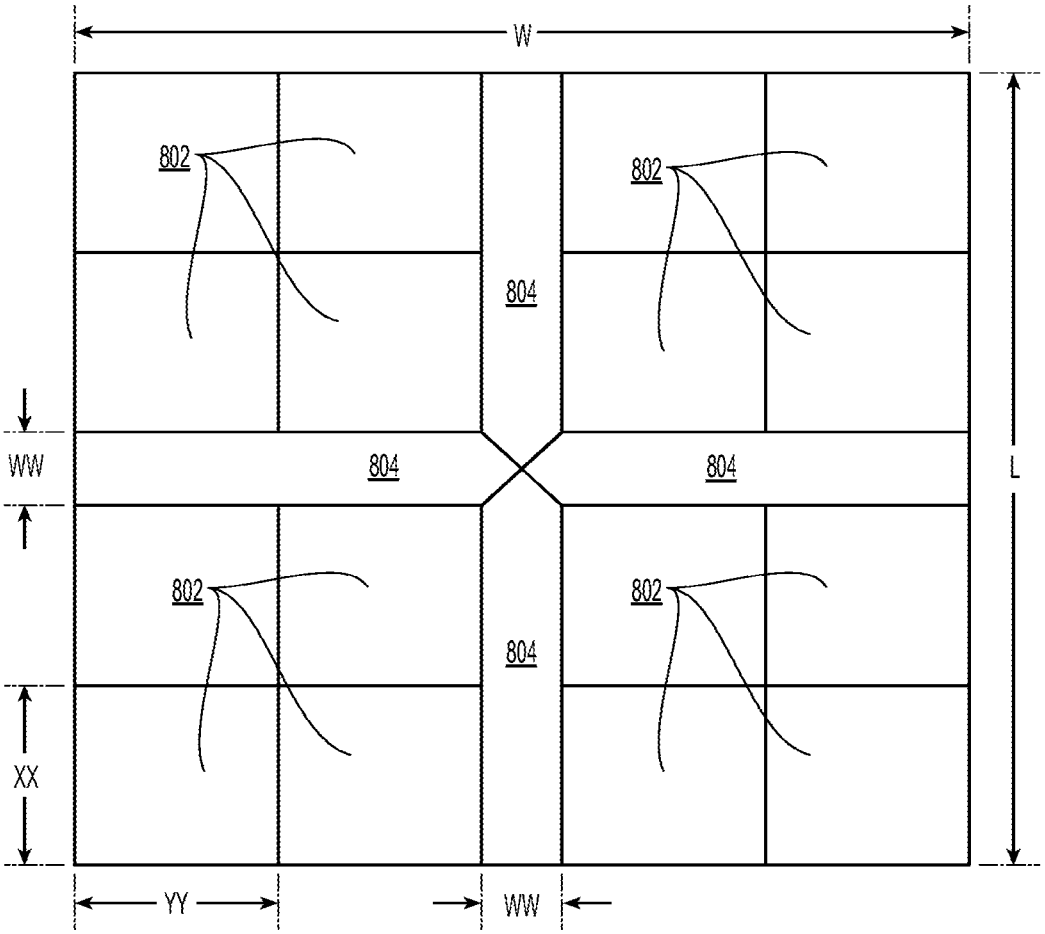
FIG. 7 is a water distribution system for testing the sprinkler of FIG. 2.

The preferred sprinkler 10 can provide a preferred water distribution; and in particular meet or exceed the water distribution requirements of one or more industry accepted standards. The water distribution performance of the preferred sprinkler is determined by disposing or more samples of the preferred sprinkler is disposed over a water collection system from which the density of the water distribution can be determined as measured in gpm/ft$^2$. Shown in FIG. 7, is schematic illustration of a water collection system 800 for determining the water distribution performance of the sprinkler 10 and in particular, the distribution performance under the FM Approval Standard Class NO. 2008 or UL 1767. The collection system 800 includes twenty collection pans that consist of sixteen substantially square non-flue pans 802 and four substantially rectangular flue pans 804 grouped in fours to define the four quadrants of the collection system. Symmetrically dissecting the non-flue pans 802 into their respective quadrants are the four flue pans 804 orthogonally oriented with respect to one another. The water collection system 800 defines a preferred width W of about 7 ft. (215 m.) and a length L of about 7 ft. (215 m.). The non-flue pans 802 are preferably square defining a surface area measuring (xx x yy) which preferably measures (20 in.×20 in.). The flue pans 804 define a preferred width ww of about 6 inch.

To determine the water distribution performance of the preferred sprinkler 10, one or more of the sprinklers are disposed and preferably centered above the water collection system 800 and beneath a ceiling in an actuated or open state (without the thermal trigger 80) to define either a ceiling-to-collection pan clearance distance or sprinkler deflector-to-collection pan clearance distance. For the test of multiple sprinklers, i.e., two or four tested over the collection system, the sprinklers 10 define a desired sprinkler spacing. Water is supplied to each of the sprinklers 10 to provide a preferred discharge pressure from the open sprinklers 10. Preferably, the system 800 includes a piping manifold for selectively feeding each sprinkler 10 from two directions (double feed) along a branch line or one direction (single feed). For the test of multiple sprinklers, i.e. two or four sprinklers over the water collection system 800, disposed on separate piping branches, the piping is spaced at a desired distance. The piping and manifold are preferably constructed with nominal two inch diameter pipe. Water is discharged from the open sprinklers for a defined duration under the test and density distribution over one or more of the collection pans 802, 804 is determined. Satisfaction of the water distribution tests under FM Approval Standard Class No. 2008 or UL 1767 standards is established by the determined densities meeting or exceeding the average and minimum discharge density criteria under the test standards.

Under FM Approval Standard Class NO. 2008, fifteen distribution tests are conducted in which one, two or four sprinklers are disposed above the water collection system. The tops of the collection pans 802, 804 are disposed at a minimum 3.3 ft. (1 m.) above the solid floor surface. For each water distribution test, water is discharged from the sprinkler 10 for a test duration of 5 minutes. Summarized in the Table 4.29 of FM Approval Standard Class No. 2008 below are the test parameters and the minimum and minimum average density criteria over the non-flue collection pans 802, flue collection pans 804 and all twenty collection pans of the collection system 800 for a particular sprinkler spacing, pipe spacing and the ceiling-to-collection clearance distance. Additional details regarding the FM Approval Standard Class No. 2008, Section 4.29 water distribution tests are shown and described in the attachments of U.S. Provisional Application No. 61/789,182.

Under the UL 1767 four distribution tests are conducted in which one, two or four sprinklers are disposed above the water collection system. The tests are conducted three times with different sprinklers for each test. For each water distribution test, water is discharged from the sprinkler 10 for a test duration of 5 minutes. Summarized in the Table 45.1 of UL 1767 below are the test parameters and the minimum and minimum average density criteria over the non-flue collection pans 802, flue collection pans 804 and all twenty collection pans of the collection system 800 for a particular sprinkler spacing, pipe spacing and the ceiling-to-collection clearance distance. Additional details regarding the UL 1767 water distribution tests are shown and described in the attachments of U.S. Provisional Application No. 61/789,182.

The preferred dry sprinkler assembly 10 having a preferred K-factor of 16.8 and deflector 100 was subject to each of the water distribution tests under FM Approval Standard Class No. 2008 or UL 1767. The preferred sprinkler 10 is believed to be suitable to satisfy each of the minimum and minimum average water distribution criteria for at least four sprinklers disposed above the water collection system 800 and more preferably suitable to satisfy each of the minimum and minimum average water distribution criteria for one, two and four sprinklers disposed above the water collection system 800 as summarized in Table 4.29 of FM Approval Standard Class No. 2008 below. In addition to the water distribution tests, embodiments of the preferred sprinkler 10 were subject to each of the ten Actual Delivered Density ("ADD") tests under Section 30 of UL 1767, details of which are shown and described in U.S. Provisional Application No. 61/789,182. Summarized in the table below are parameters of the UL 1767 ADD test with the test pressures to which the sprinkler was subjected indicated in the "Pressure (psi)" column. Results of the sprinkler testing are also provided in the summary table. The subject sprinkler satisfied the test by meeting or exceeding each of the required ADD average criteria values. With regard to the "Flue Space Avg" test, the dry sprinkler satisfied each of the two required tests, i.e. Test 1 and Test 2. For each of the remaining eight UL tests, the subject sprinkler provided an average ADD such that the total of the ADD averages exceed the required average total, i.e., 4.6 gpm/sq. ft.

TABLE 4.29 of FM Approval Standard Class No. 2008

| Number of Sprinklers Over the Water Collection System | Sprinkler Spacing ft. (m) | Pipe Spacing ft. (m) | Ceiling Clearance to Water Collection Pans ft-in (m) | Pressure psi. (bar) | Minimum 16-pan Average Density gal/min/ft$^2$ (mm/min) | Minimum Flue Space (4 Pans) Average gal/min/ft$^2$ (mm/min) | Minimum 20-Pan Average Density gal/min/ft$^2$ (mm/min) | Minimum Non-flue 10-pan Average gal/min/ft$^2$ (mm/min) | Minimum Single Non-flue-pan Density gal/min/ft$^2$ (mm/min) |
|---|---|---|---|---|---|---|---|---|---|
| 1 | 0 (0) | 0 (0) | 10 (3.04) | 35 (2.4) | 0.52 (21.22) | 1.0 (40.80) | N/R | N/R | N/R |
| 1 | 0 (0) | 0 (0) | 14-6 (4.42) | 35 (2.4) | 0.48 (19.58) | 0.89 (36.31) | N/R | N/R | N/R |
| 1 | 0 (0) | 0 (0) | 14-6 (4.42) | 50 (3.4) | N/R | 1.7 (69.36) | 0.91 (37.13) | 0.50 (20.40) | 0.26 (10.61) |
| 2 | 10 (3.04) | 0 (0) | 4-2 (1.27) | 35 (2.4) | 0.60 (24.48) | N/R | N/R | N/R | N/R |
| 2 | 10 (3.04) | 0 (0) | 10 (3.04) | 35 (2.4) | 0.54 (22.03) | N/R | N/R | N/R | N/R |
| 2 | 0 (0) | 10 (3.04) | 4-2 (1.27) | 35 (2.4) | 0.58 (23.66) | N/R | N/R | N/R | N/R |
| 2 | 0 (0) | 10 (3.04) | 10 (3.04) | 35 (2.4) | 0.57 (23.26) | N/R | N/R | N/R | N/R |
| 2 | 12 (3.66) | 0 (0) | 4-2 (1.27) | 35 (2.4) | 0.44 (17.95) | N/R | N/R | N/R | N/R |
| 2 | 0 (0) | 12 (3.66) | 4-2 (1.27) | 35 (2.4) | 0.45 (18.36) | N/R | N/R | N/R | N/R |
| 2 | 10 (3.04) | 0 (0) | 4-2 (1.27) | 50 (34) | N/R | N/R | 0.77 (31.42) | 0.60 (24.48) | 0.20 (8.16) |
| 2 | 0 (0) | 10 (3.04) | 4-2 (1.27) | 50 (3.4) | N/R | N/R | 0.77 (31.42) | 0.60 (24.48) | 0.20 (8.16) |
| 4 | 10 (3.04) | 10 (3.04) | 4-2 (1.27) | 30 (2.4) | 0.68 (27.74) | N/R | N/R | N/R | N/R |
| 4 | 10 (3.04) | 10 (3.04) | 10 (3.04) | 35 (2.4) | 0.86 (35.09) | N/R | N/R | N/R | N/R |
| 4 | 8 (2.44) | 12 (3.6) | 4-2 (1.27) | 35 (2.4) | 0.66 (26.93) | N/R | N/R | N/R | N/R |
| 4 | 10 (3.04) | 10 (3.04) | 4-2 (1.27) | 50 (3.4) | N/R | N/R | 0.71 (28.97) | 0.60 (24.48) | 0.37 (15.10) |

TABLE 45.1 of UL 1767

| Number of Sprinklers Over the Water Collection System | Sprinkler Spacing ft. | Pipe Spacing ft. | Deflector Clearance to Water Collection Pans ft-in | Pressure psi.* | Minimum Flue Space (4 Pans) Average gal/min/ft$^2$ | Minimum 20-Pan Average Density gal/min/ft$^2$ | Minimum Non-flue 10-pan Average gal/min/ft$^2$ | Minimum Single Non-flue-pan Density gal/min/ft$^2$ |
|---|---|---|---|---|---|---|---|---|
| 1 | 0 | 0 | 14-6 | 50 | 1.7 | 0.91 | 0.50 | 0.24 |
| 2 | 10 | 0 | 4-2 | 50 | N/R | 0.77 | 0.60 | 0.20 |
| 2 | 0 | 10 | 4-2 | 50 | N/R | 0.75 | 0.60 | 0.20 |
| 4 | 10 | 10 | 4-2 | 50 | N/R | 0.71 | 0.60 | 0.37 |

*Pressure of 50 psi. is for a sprinkler with a K-factor of 16.8. For a sprinkler with a K-factor of 14.0, the pressure should be adjusted to 75 psi.

TABLE of UL 1767 ADD Criteria and Results

| Test Number | Number of sprinklers centered over the ADD apparatus | Sprinkler spacing (ft) | Pipe spacing (ft) | Deflector to water collector clearance | Freeburn convective heat release (kBtu/min) | Pressure (psi) | Direction of feed flow | Minimum 16-pan average ADD, pans 1-16 (gpm/ft$^2$) | Result (gpm/ft$^2$) | Minimum flue space (4 pan) average, pans 17-20 (gpm/ft$^2$) | Results (gpm/ft$^2$) |
|---|---|---|---|---|---|---|---|---|---|---|---|
| 1 | 1 | 0 | 0 | 15 | 75 | 35 | Double | 0.28 | 0.31 | 1 | 1.47 |
| 2 | 1 | 0 | 0 | 15 | 150 | 35 | Double | 0.28 | 0.32 | 1 | 1.66 |
| 3 | 2 | 12 | 0 | 3 | 150 | 35 | Double | 0.25 | 0.55 | N/R | 0.38 |
| 4 | 2 | 12 | 0 | 3 | 150 | 100 | Double | 0.35 | 0.52 | N/R | 0.15 |
| 5 | 2 | 12 | 0 | 15 | 150 | 35 | Double | 0.2 | 0.44 | N/R | 1.56 |
| 6 | 2 | 0 | 12 | 3 | 150 | 35 | Double | 0.25 | 0.46 | N/R | 0.64 |

TABLE-continued of UL 1767 ADD Criteria and Results

| Test Number | Number of sprinklers centered over the ADD apparatus | Sprinkler spacing (ft) | Pipe spacing (ft) | Deflector to water collector clearance | Freeburn convective heat release (kBtu/min) | Pressure (psi) | Direction of feed flow | Minimum 16-pan average ADD, pans 1-16 (gpm/ft$^2$) | Result (gpm/ft$^2$) | Minimum flue space (4 pan) average, pans 17-20 (gpm/ft$^2$) | Results (gpm/ft$^2$) |
|---|---|---|---|---|---|---|---|---|---|---|---|
| 7 | 2 | 0 | 12 | 3 | 150 | 100 | Double | 0.4 | 0.61 | N/R | 1 |
| 8 | 2 | 0 | 12 | 15 | 150 | 35 | Double | 0.2 | 0.5 | N/R | 0.14 |
| 9 | 4 | 8 | 12 | 3 | 150 | 35 | Double | 0.5 | 0.6 | N/R | 1.84 |
| 10 | 4 | 8 | 12 | 3 | 150 | 100 | Double | 0.6 | 0.94 | N/R | 1.54 |
| | | | | | | | Total | 3.8 | 5.25 | 4.6 | 10.38 |

Figure 8A:
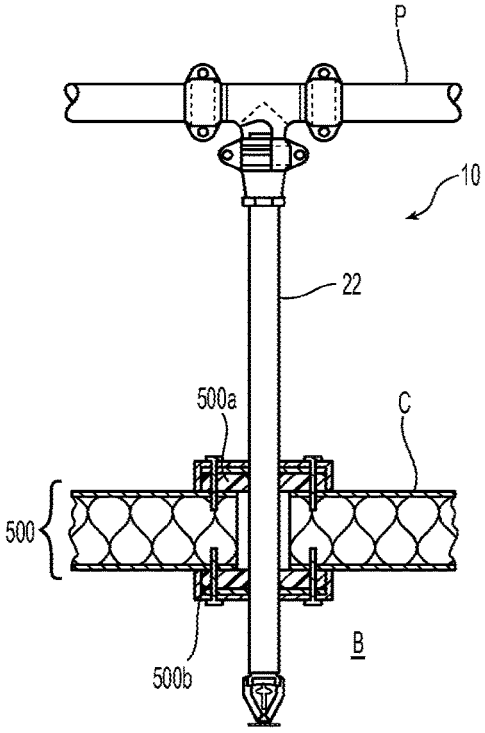
FIG. 8A is a plan and partial cross-sectional view of the preferred deflector and sprinkler assembly of FIG. 2 installed in an insulated wall with a seal.
Figure 8B:
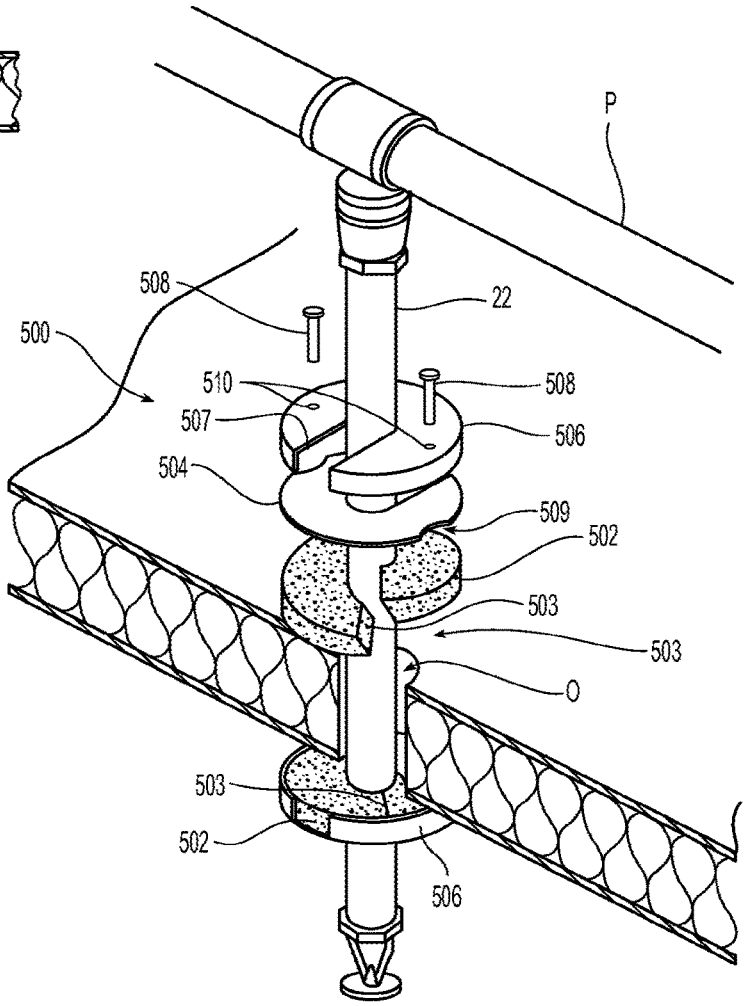
FIG. 8B is an isometric, partial cross-sectional, and exploded view of the preferred deflector and sprinkler assembly of FIG. 7 installed in an insulated wall with a seal.

With reference to FIGS. 8A and 8B, and as previously described, the dry sprinkler 10 may be used in the protection of cold storage occupancies and in particular refrigerated storage occupancies. Typically, in a dry sprinkler installation for a cold environment, the dry sprinkler supply piping or its casing penetrates and extends through a hole or opening in the ceiling of the cold or refrigerated environment in which the sprinkler is disposed to protect the occupancy. Generally, warm air outside the cold environment has a higher relative humidity than the cold air within the cold or refrigerated environment. If the warm outside air mixes with the refrigerated environment, the cold temperatures may cause the moisture in the warm air to condense. As the moisture condenses, water droplets form and can accumulate around and on the sprinkler head. As these droplets freeze, ice may accumulate on the sprinkler head. A significant accumulation of ice on the sprinkler head may impair the operability of the sprinkler head such as to delay or prevent operation of the sprinkler head in the event of a fire or effect premature operation of the sprinkler head in absence of a fire. Accordingly, it is desirable to provide an insulating seal around the sprinkler supply piping or casing at the location of the penetration into the refrigerated occupancy to eliminate or minimize the heat exchange between the warmer outer environment and the cold interior of the occupancy.

Referring to FIGS. 8A and 8B, shown is a preferred insulated refrigerated storage installation for the dry sprinkler 10, which is shown coupled to a fluid supply main pipe P with the sprinkler casing 22 penetrating the wall or ceiling C of the refrigerated occupancy through an opening O formed in the ceiling C. In one preferred installation, the opening O preferably defines a diameter of about three inches with a clearance or annular void about the casing 22. To provide an insulated seal between the warm external environment A and the cold and more particularly freezing interior environment B, an insulation assembly 500 is disposed about the sprinkler casing 22 at the exterior surface of the ceiling C of the refrigerated occupancy. More preferably, a first insulation assembly 500*a* is located adjacent the exterior surface of the ceiling C and a second insulation assembly 500*b* is located adjacent the interior surface of the ceiling C so as to insulate and seal about the dry sprinkler 10 on each side of the ceiling C of the opening O.

Figure 9:
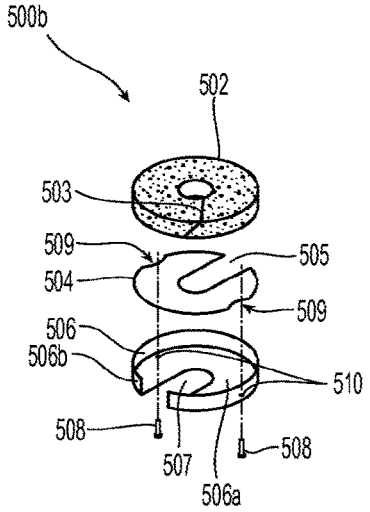
FIG. 9 is an isometric and exploded view of a preferred insulating assembly.

With reference to the perspective view of FIGS. 8B and 9, each of the preferred insulation sealing assemblies 500*a*, 500*b* includes an insulation ring 502, an insert member 504 and a housing 506 with securing means 508 to secure the insulation scaling assembly to the ceiling C. For the preferred installation, the insulation ring 502 is wrapped about and preferably engaged about the dry sprinkler casing 22. The insulation ring 502 is further preferably located adjacent to and engaged with the surface of the ceiling C. The insulation ring 502 preferably includes a split 503 to facilitate wrapping of the insulation ring about the dry sprinkler casing 22 to abut interior or exterior surfaces of the ceiling C. The insulation ring 502 is preferably a flexible member made of an insulating material such as for example, polyethylene foam rubber, although other materials may be used provided they provide sufficient sealing and insulation. With the insulation ring 502 installed, the insert member 504 is placed over or atop the ring 502. The insert member 504 is preferably a plate or planar member that includes a radially extending slot 505 and is formed and sized for engaging or locating the insert member 504 about the dry sprinkler casing 22. Preferably laterally disposed or formed about the slot 505 are a pair of voids 509 to expose a surface of the insulation ring 502 in order to secure the assembly 500*a*, 500*b* to the ceiling C as described in greater detail below.

In the assembly 500*a*, 500*b*, the housing 506 is disposed over the insert member 504 and the insulation ring 502. The housing 506 is preferably disc or cylindrical in shape having a planar top or cap 506*a* and an annular wall 506*b*. Preferably formed in the cap 506*a* is a housing slot 507 to engage or locate the housing 506 about the dry sprinkler casing 22. The housing slot 507 extends radially inward from the annular wall 506*b* to define an aperture in the annular wall. Accordingly, as seen in the assembled view of insulating assembly 500*b* in FIG. 8B, a portion of the insulation ring 502 is visible from the side of the assembly at the aperture formed along the annular wall 506*b* at the housing slot 507. The housing 506 is preferably sized and made of a sufficiently hard and stiff material to protect and compact the insulation ring 502 and insert 504 about the sprinkler casing 22 and ceiling surface. Preferably formed in the cap 506*a* of the housing are a pair of through holes 510 disposed about the housing slot 507 to facilitate installation of the assembly as described in greater detail below.

In the preferred assembly, 500*a*, 500*b*, the slit 503 of the insulation ring 502 and the slots 505, 507 and voids 509 of the insert member 504 and housing 506 are preferably oriented with respect to one another to facilitate the installation of the assembly and eliminate or otherwise minimize pinching of the insulation ring 502. In the preferred installation, the insulation ring is wrapped about the casing 22 of the dry sprinkler 10 and engaged or disposed against the interior/exterior surface of the ceiling C. The insert member 504 is disposed atop the insulation ring 502 such that the slot 505 is located offset relative to the split 503 of the insulation ring 502 and more preferably located such that the slit 503 is radially aligned between the slot 505 and one of the voids 509 of the insert member 504. The housing 506 is preferably disposed or located over the insert member 504 and insulation ring 502 such that the first housing slot 507 and the aperture formed in the annular wall 506*b* are offset and more preferably about 180 degrees offset from the second slot 505 of the insert member 504. The insert member 504, disposed between the housing 506 and the insulation ring 502, provides protection over the insulation ring 502 where there is a gap in the cap 506*a* defined by the housing slot 507; and the aperture formed in the annular wall 506*b* preferably leaves the side of the insulation ring 502 visible from the side of the assembly. The through holes 510 of the housing 506 are preferably axially aligned over the voids 509 of the insert member 504 and the surface of the insulating ring 502 exposed by the voids 509. To secure the insulation sealing assembly 500 to the ceiling C, securing means 508, such as for example, self-threading screws, nails or other types of mechanical fasteners, extend through the through holes 510 and preferably penetrate the insulation ring 502 at the portions exposed by the voids 509 of the insulating member. The securing means 508 preferably anchor to the ceiling C to secure the insulation sealing assembly 500*a*, 500*b* to the ceiling C.

The dry sprinkler of the preferred embodiments have demonstrated the capability to satisfactorily address a fire for protection of a particular hazard, occupancy and/or commodity. More specifically, preferred embodiments of the dry sprinkler have demonstrated a capability to suppress large-scale fires for particular storage arrangements and commodity types by compliance with specific fire test requirements. These actual fire tests prove the performance of the preferred embodiments to provide the a fire protection with a sprinkler that suppresses a fire with a dry sprinkler, in which the sprinkler has a nominal k-factor of 16.8 or greater. Thus, alone or in combination with the referenced distribution tests, the preferred embodiments are believed to provide the first known dry sprinkler with K-factors greater than 14 that provided protection for particular high challenge commodities, such as, for example, at least one of Class I-IV and Cartoned Unexpanded Group A Plastics commodity as defined by NFPA 13 (2013 Edition).

Figure 10:
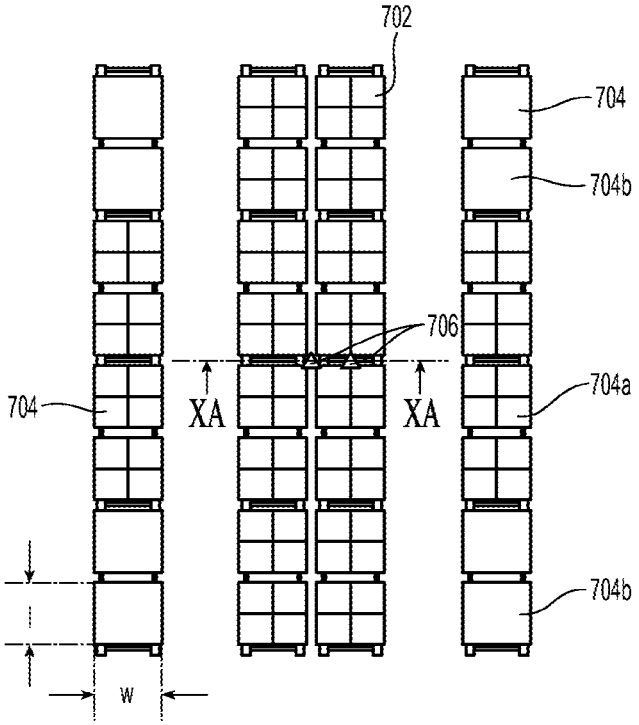
FIGS. 10, 10A and 10B show various views of a test commodity arrangement for testing the sprinkler of FIG. 2.
Figure 10A:
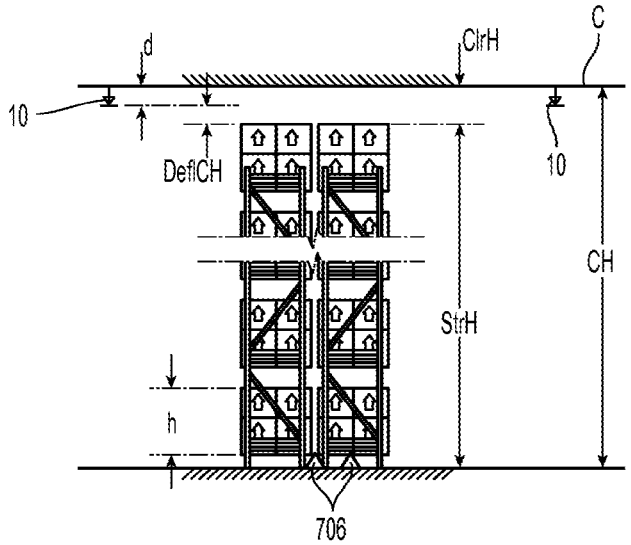
Figure 10B:
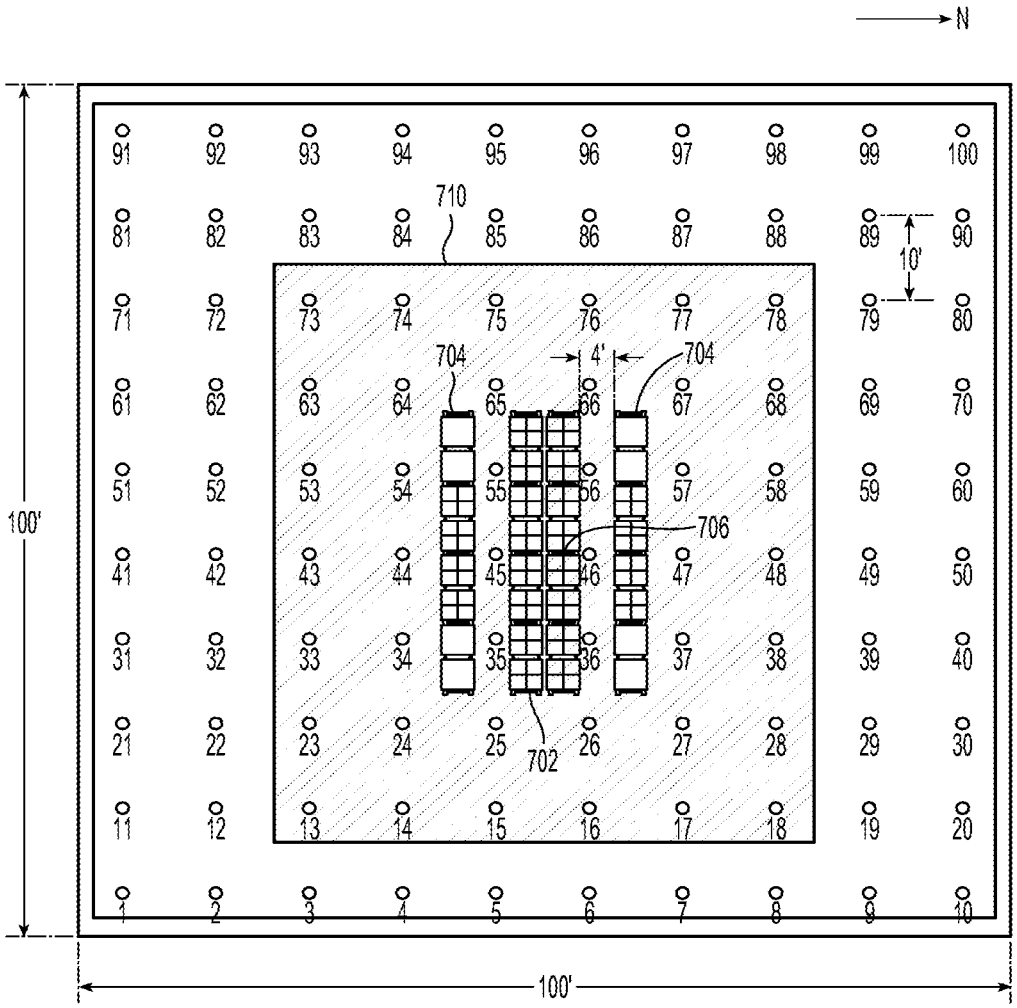

Shown in FIGS. 10, 10A and 10B is a general test arrangement for large fire scale testing. Shown is a storage arrangement 700 of one or more commodities having a main array 702 disposed between two target arrays 704 defining aisle widths AW of 4 feet. The storage 700 is located beneath a ceiling C defining ceiling height CH. Referring to FIGS. 10A and 10B, the commodity is preferably stored upon rack shelving. The commodity preferably defines a commodity height h of about 4 feet, a commodity length l of about 3½ feet, and a commodity width w of about 3½ feet. The storage arrangement 700 includes one or more rows of the commodity. The main array 702 preferably defines a double row rack arrangement and a target array 704 preferably includes a single row arrangement. The preferred storage arrangement 700 defines a nominal storage height StrH beneath the ceiling C to define a storage clearance height ClrH. Preferred embodiments of the sprinkler 100 are installed beneath the ceiling C to define a preferred grid arrangement. The preferred dry sprinklers 10 are installed to define a nominal storage-to-deflector clearance height DeflCH and ceiling-to-deflector distance d. Shown in FIG. 10C is a preferred sprinkler grid arrangement of up to one hundred dry sprinklers 10 having a sprinkler-to-sprinkler spacing (x x y).

In one particular preferred test arrangement and fire test, a storage arrangement 700 included a main array 702 of double row rack Group A plastic commodity disposed between two single row target arrays 704 having a central portion 704*a* of standard cartoned Group A plastic commodity between two end portions 704*b* of Class II commodity. The stored commodity 700 was stored to a preferred nominal storage height StrH of 20 ft. beneath the ceiling C having a preferred nominal ceiling height CH of 40 ft. to define a preferred storage-to-ceiling clearance height ClrH of 20 ft. A test group 710 or sample of forty-two of the preferred dry sprinkler 10 were installed in the preferred grid arrangement at a preferred sprinkler-to-sprinkler spacing (x x y) of 10 ft.×10 ft. to define a nominal storage-to-sprinkler deflector clearance DeflCH of 20 ft. and ceiling-to-deflector distance d of 14 inches. Water was supplied to each of the sprinklers 10 to provide a preferred nominal discharge pressure of 52 psi. The installed sprinklers 10 preferably include a thermal trigger 80 having thermal rating of 165° F. A fire was ignited and located in the main array 702 at the preferred location 706 between two sprinklers. In response to the fire, a single sprinkler operated and discharged resulting in a maximum average gas temperature at the ceiling above the ignition location of about 75° F. The test was permitted to run for approximately thirty minutes. Fire did not spread across the aisle from the main array 702 to either of the target arrays. The was no sustained combustion observed at either the outer edges of the target array no at the ends of the main array.

In another fire test arrangement, the storage arrangement 700 included a main array 702 of double row rack standard cartoned Group A plastic commodity disposed between two single row target arrays 704 having a central portion 704*a* of Group A plastic commodity between two end portions 704*b* of Class II commodity. The stored commodity 700 was stored to a preferred nominal storage height StrH of 25 ft. beneath the ceiling C having a preferred nominal ceiling height CH of 30 ft. to define a preferred storage-to-ceiling clearance height ClrH of 5 ft. A test group 710 of forty-two of the preferred dry sprinkler 10 were installed in the preferred grid arrangement at a preferred sprinkler-to-sprinkler spacing (x x y) of 8 ft.×12 ft. to define a nominal storage-to-sprinkler deflector clearance DeflCH of 5 ft. and ceiling-to-deflector distance d of 14 inches. Water was supplied to each of the sprinklers 10 to provide a preferred nominal discharge pressure of 35 psi. The installed sprinklers 10 preferably include a thermal trigger 80 having a thermal rating of 165° F. A fire was ignited and located in the main array 702 at the preferred location 706 between two sprinklers. In response to the fire, a total of five sprinklers operated and discharged. Fire did not spread across the aisle from the main array 702 to either of the target arrays.

In another fire test arrangement, the storage arrangement 700 included a main array 702 of double row rack standard cartoned Group A plastic commodity disposed between two single row target arrays 704 having a central portion 704*a* of Group A plastic commodity between two end portions 704*b* of Class II commodity. The stored commodity 700 was stored to a preferred nominal storage height StrH of 20 ft. beneath the ceiling C having a preferred nominal ceiling height CH of 30 ft. to define a preferred storage-to-ceiling clearance height ClrH of 10 ft. A test group 710 of forty-nine of the preferred dry sprinkler 10 were installed in the preferred grid arrangement at a preferred sprinkler-to-sprinkler spacing (x x y) of 8 ft.×8 ft. to define a nominal storage-to-sprinkler deflector clearance DeflCH of 10 ft. and ceiling-to-deflector distance d of 14 inches. Water was supplied to each of the sprinklers 10 to provide a preferred nominal discharge pressure of 35 psi. The installed sprinklers 10 preferably include a thermal trigger 80 having a thermal rating of 165° F. A fire was ignited and located in the main array 702 at the preferred location 706 beneath one sprinkler. In response to the fire, a total of one sprinkler operated and discharged. Fire did not spread across the aisle from the main array 702 to either of the target arrays.

Based on the performance of the preferred sprinkler 10 in each of the test arrangements, the preferred sprinkler 10 is capable of suppressing large-scale fires to protect rack storage arrangements that include standard cartoned unexpanded Group A plastic commodity. Moreover, the preferred sprinkler demonstrated compliance with pendent ESFR test requirements under UL 1767 to demonstrate the capability to suppress large-scale fires that include rack storage of unexpanded cartoned Group A plastic commodity. UL 1767 pendent ESFR test requirements require for sprinklers having a nominal K-factor of 16.8 or greater subject to the previously described test fires to operate no more than nine (9) sprinklers, when the storage-to-ceiling clearance ClrH is 20 ft. and no more than six (6) sprinklers when the clearance ClrH is 5 ft. In addition, the test fire must result in a one minute average steel temperature that does not exceed 1000° F. The test results must also demonstrate that there was no regrowth of the fire at the end of the fire test, which would otherwise be evidenced by significantly increasing steel or gas temperatures at the ceiling C. Additionally, the test must demonstrate the satisfactory suppression of fire spread as evidenced by the absence of sustained combustion at the end of the main array 702 and none at the outer edges of the target arrays 704. Additional details of the tests and the results are shown and described in U.S. Provisional Application 61/789,182.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following Features of the Invention, and equivalents thereof.

What is claimed is:

1. A sprinkler assembly, comprising:

an outer structure assembly defining a passageway comprising an inlet and an outlet, the passageway defining an axis; at least one frame arm coupled with the outer structure assembly, the at least one frame arm defining a first plane that includes the axis and a second plane perpendicular to the first plane; and a deflector coupled with the at least one frame arm, the deflector comprising a plurality of tines comprising a first pair of diametrically opposed T-shaped tines bisected by the first plane and a second pair of diametrically opposed T-shaped tines bisected by the second plane, the first pair of diametrically opposed T-shaped tines having linear edges, the second pair of diametrically opposed T-shaped tines having a second width greater than a first width of a widest portion of the first pair of diametrically opposed T-shaped tines, the second pair of diametrically opposed t-shaped tines having concave edges, the first pair of diametrically opposed T-shaped tines and the second pair of diametrically opposed T-shaped tines forming a non-circular perimeter and each extending from a central portion to a terminal portion further from the outlet than the central portion.

2. The sprinkler assembly of claim 1, comprising:

a casing tube between the inlet and the outlet.

3. The sprinkler assembly of claim 1, comprising:

the deflector comprises the central portion centered about the axis, each tine having a base extending from the central portion, a body extending away from the base, the terminal portion extending from the body to a terminal edge, and a pair of lateral edges extending from the base to the terminal edge, the plurality of tines being circumferentially spaced about the central portion to defines a plurality of slots therebetween, the lateral edges of circumferentially adjacent tines converging to define an innermost portion of one of the plurality of slots, the innermost portion of each slot defining a radiused end having the shortest radial distance of the slot to the axis of the radiused end.

4. The sprinkler assembly of claim 1, comprising:

the at least one frame arm comprises a pair of spaced apart arms.

5. The sprinkler assembly of claim 1, comprising:

the at least one frame arm comprises a pair of spaced apart arms aligned along the first plane, the axis being disposed along the intersection of the first and second planes, the first and second plane dissecting the deflector into four quadrants about the axis.

6. The sprinkler assembly of claim 1, comprising:

the outlet defines a nominal K-factor of at least 16.8 $GPM/PSI^{1/2}$.

7. The sprinkler assembly of claim 1, comprising:

the plurality of tines include symmetrical tines and asymmetrical tines that present a non-planar surface to the outlet, the symmetrical tines including the first pair of diametrically opposed T-shaped tines, which are bisected by the first plane, and the second pair of diametrically opposed T-shaped tines, which are bisected by the second plane, and the asymmetrical tines being disposed circumferentially between the first and second pair of diametrically opposed T-shaped tines.

8. The sprinkler assembly of claim 1, comprising:

each tine of the plurality of tines is angled relative to the central portion at an angle, radially adjacent tines defining different angles relative to the central portion.

9. The sprinkler assembly of claim 1, comprising:

a first pair of the plurality of tines define a radial length smaller than a radial length defined by a second pair of the plurality of tines.

10. The sprinkler assembly of claim 1, comprising:

at least two tines of the plurality of tines include a bend portion.

11. The sprinkler assembly of claim 1, comprising:

at least one tine of the plurality of tines defines a convex surface relative to the outlet, the convex surface defining a radius of curvature of approximately 1.5 inches.

12. The sprinkler assembly of claim 1, comprising:

a thermal trigger that actuates to slide an inner structural assembly to permit flow of fluid through the internal passageway.

13. A sprinkler system, comprising:

a plurality of sprinklers above a rack storage arrangement, each sprinkler of the plurality of sprinklers comprising: an outer structure assembly defining a passageway comprising an inlet and an outlet, the passageway defining an axis; at least one frame arm coupled with the outer structure assembly, the at least one frame arm defining a first plane that includes the axis and a second plane perpendicular to the first plane; and a deflector coupled with the at least one frame arm, the deflector comprising a plurality of tines comprising a first pair of diametrically opposed T-shaped tines bisected by the first plane and a second pair of diametrically opposed T-shaped tines bisected by the second plane, the second pair of diametrically opposed T-shaped tines having a second width greater than a first width of a widest portion of the first pair of diametrically opposed T-shaped tines, the second pair of diametrically opposed t-shaped tines having concave edges, the first pair of diametrically opposed T-shaped tines and the second pair of diametrically opposed T-shaped tines forming a non-circular perimeter and each extending from a central portion to a terminal portion further from the outlet than the central portion, the first pair of diametrically opposed T-shaped tines having linear edges.

14. The sprinkler system of claim 13, comprising:

the rack storage arrangement comprises a plastic commodity.

15. The sprinkler system of claim 13, comprising:

the rack storage arrangement has a nominal storage height of at least 20 feet beneath a ceiling with a maximum nominal 40 foot ceiling height.

16. The sprinkler system of claim 13, comprising:

at least one of a wet pipe system and a dry pipe system coupled with the plurality of sprinklers.

17. The sprinkler system of claim 13, comprising:

each sprinkler comprises a casing tube between the inlet and the outlet.

18. The sprinkler system of claim 13, comprising:

the at least one frame arm comprises a pair of spaced apart arms.

19. The sprinkler system of claim 13, comprising:

each sprinkler has a nominal K-factor of at least 16.8 $GPM/PSI^{1/2}$.

20. The sprinkler system of claim 13, comprising:

a first pair of the plurality of tines define a radial length smaller than a radial length defined by a second pair of the plurality of tines.

* * * * *